US010472136B2

(12) United States Patent
Giraud et al.

(10) Patent No.: US 10,472,136 B2
(45) Date of Patent: Nov. 12, 2019

(54) CONTAINER WITH BUTTON RELEASE

(71) Applicant: CSP TECHNOLOGIES, INC., Auburn, AL (US)

(72) Inventors: Jean-Pierre Giraud, Auburn, AL (US); Herve Pichot, Chennevieres-sur-Marne (FR); Franklin Lee Lucas, Jr., Opelika, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 0 days.

(21) Appl. No.: 15/950,784

(22) Filed: Apr. 11, 2018

(65) Prior Publication Data

US 2018/0229902 A1 Aug. 16, 2018

Related U.S. Application Data

(63) Continuation of application No. 14/782,263, filed as application No. PCT/US2014/033948 on Apr. 14, 2014, now Pat. No. 9,975,670.

(Continued)

(51) Int. Cl.
*B65D 43/26* (2006.01)
*B65D 43/16* (2006.01)

(Continued)

(52) U.S. Cl.
CPC ..... *B65D 43/26* (2013.01); *B65D 43/16* (2013.01); *B65D 43/22* (2013.01); *B65D 50/066* (2013.01); *B65D 2215/04* (2013.01)

(58) Field of Classification Search
CPC ..... B65D 43/26; B65D 43/16; B65D 43/22; B65D 50/06
See application file for complete search history.

(56) References Cited

U.S. PATENT DOCUMENTS 4,126,224 A 11/1978 Laauwe et al.
4,260,067 A 4/1981 Andruchiw (Continued)

FOREIGN PATENT DOCUMENTS

EP 0603090 A1 6/1994
EP 1582476 A1 10/2005

(Continued)

*Primary Examiner* — Anthony D Stashick
*Assistant Examiner* — James R Way
(74) *Attorney, Agent, or Firm* — Mark T. Vogelbacker; Eckert Seamans Cherin & Mellott, LLC

(57) ABSTRACT

A container includes container body (120) defining an interior (122) and an opening (124) leading to the interior. A lid (140) is movable with respect to the container body to move the container between a closed position in which the lid covers the opening and an opened position in which the opening is exposed. A housing (180) is affixed to an upper portion of the container body, adjacent to the opening. A release (160) is movably housed within the housing. The release is configured to move between a locked position in which the release retains the lid in the closed position, and an unlocked position, in which the release permits the lid to move into the opened position. The release moves from the locked position to the unlocked position by a first movement in a radially inward direction of the container, followed by a second movement in an axially upward direction of the container.

17 Claims, 41 Drawing Sheets

Related U.S. Application Data

(60) Provisional application No. 61/847,124, filed on Jul. 17, 2013, provisional application No. 61/812,761, filed on Apr. 17, 2013, provisional application No. 61/812,753, filed on Apr. 17, 2013, provisional application No. 61/812,747, filed on Apr. 17, 2013.

(51) Int. Cl.
*B65D 43/22* (2006.01)
*B65D 50/06* (2006.01)

(56) References Cited

U.S. PATENT DOCUMENTS

| | | | | |
|---|---|---|---|---|
| 4,512,484 | A * | 4/1985 | Mar | B65D 55/10 206/1.5 |
| 5,031,784 | A | 7/1991 | Wright | |
| 5,579,957 | A | 12/1996 | Gentile et al. | |
| 5,819,967 | A | 10/1998 | Lo | |
| 5,911,937 | A | 6/1999 | Hekal | |
| 6,036,036 | A | 3/2000 | Bilani et al. | |
| 6,080,350 | A | 6/2000 | Hekal | |
| 6,082,572 | A | 7/2000 | Galton-Fenzi et al. | |
| 6,124,006 | A | 9/2000 | Hekal | |
| 6,130,263 | A | 10/2000 | Hekal | |
| 6,174,952 | B1 | 1/2001 | Hekal | |
| 6,176,381 | B1 * | 1/2001 | Mader | B65D 50/067 215/217 |
| 6,214,255 | B1 | 4/2001 | Hekal | |
| 6,221,446 | B1 | 4/2001 | Hekal | |
| 7,000,792 | B2 | 7/2006 | Arai | |
| 7,213,720 | B2 | 5/2007 | Giraud | |
| 7,296,711 | B2 | 11/2007 | Goto et al. | |
| 7,404,495 | B2 | 7/2008 | Keung | |
| 7,537,137 | B2 | 5/2009 | Giraud | |
| 7,611,024 | B2 | 11/2009 | Yamanaka et al. | |
| 7,654,411 | B2 | 2/2010 | Boots et al. | |
| 7,721,907 | B2 | 5/2010 | Keung | |
| 7,735,665 | B2 | 6/2010 | Robinson | |
| 7,798,348 | B2 | 9/2010 | Sawyer | |
| 8,292,110 | B2 | 10/2012 | Rutter et al. | |
| 8,469,212 | B2 | 6/2013 | Goto et al. | |
| 8,479,935 | B2 | 7/2013 | Straughan | |
| 8,528,778 | B2 | 9/2013 | Giraud | |
| 8,550,269 | B2 | 10/2013 | Lane | |
| 8,596,493 | B2 | 12/2013 | Vollers et al. | |
| 9,352,889 | B2 | 5/2016 | Giraud et al. | |
| 2006/0096984 | A1 | 5/2006 | Bandoh et al. | |
| 2007/0170191 | A1 | 7/2007 | Arvidsson et al. | |
| 2007/0228042 | A1 | 10/2007 | Yeager | |
| 2010/0051572 | A1 | 3/2010 | Beecroft et al. | |
| 2015/0048088 | A1 | 2/2015 | Giraud et al. | |

FOREIGN PATENT DOCUMENTS

| | | | |
|---|---|---|---|
| ES | 2332979 | B1 | 12/2010 |
| GB | 2082552 | A | 3/1982 |
| GB | 2166423 | A | 5/1986 |
| GB | 2449505 | A | 11/2008 |
| JP | H09 315455 | A | 12/1997 |
| JP | H03517043 | B2 | 4/2004 |
| JP | 4014836 | B2 | 11/2007 |
| WO | 9825836 | A1 | 6/1998 |
| WO | 07065240 | A1 | 6/2007 |

* cited by examiner

CONTAINER WITH BUTTON RELEASE

This application is a Continuation of U.S. application Ser. No. 14/782,263, filed Oct. 2, 2015 which is a U.S. National Phase of International Application No. PCT/US2014/033948, filed Apr. 14, 2014, which claims priority to U.S. Provisional Application Nos. 61/812,747, filed Apr. 17, 2013; 61/812,753, filed Apr. 17, 2013, 61/812,761, filed Apr. 17, 2013 and 61/847,124, filed Jul. 17, 2013. The entire specification and all the drawings of the provisional applications are incorporated here by reference to provide continuity of disclosure.

BACKGROUND

Field of Invention

Product packaging can be used to enhance products with features such as environmental protection, protection from being damaged and child resistance protection. Ideally, such packaging is provided in a way that is easy and convenient for the consumer using the product.

One common form of product packaging is a vial, which typically includes a body portion, an opening formed at the top thereof and removable lid for covering the opening. The lid may be attached to the body portion by a hinge. Typically, the entire product is exposed when the package is opened. If the product needs to be protected from the environment, for example humidity, then a seal is required. If the product is not suited for children, then a way of providing child resistance is needed.

A need exists for a simple, easy to configure packaging that can accommodate different types of products and packaging requirements.

SUMMARY

The invention relates to a container for storing products therein. The container includes a container body defining an interior for housing the products and an opening leading to the interior. The container further includes a lid that is movable with respect to the container body to move the container between a closed position in which the lid covers the opening and encloses the products therein, and an opened position in which the opening is exposed. The container further includes a housing that is affixed to an upper portion of the container body, adjacent to the opening. A release is movably housed within the housing. The release is configured to move between a locked position in which the release retains the lid in the closed position, and an unlocked position, in which the release permits the lid to move into the opened position. The release moves from the locked position to the unlocked position by a first movement in a radially inward direction of the container, followed by a second movement in an axially upward direction of the container.

The invention further relates to a method of moving a container between an opened position and a closed position. The method includes providing the container. The container includes a container body defining an interior for housing the products, and an opening leading to the interior. The container further includes a lid that is movable with respect to the container body to move the container between a closed position in which the lid covers the opening, and an opened position in which the opening is exposed. The container further includes a housing affixed to an upper portion of the container body, adjacent to the opening. A release is movably housed within the housing. The release is configured to move between a locked position in which the release retains the lid in the closed position, and an unlocked position, in which the release permits the lid to move into the opened position. The method further includes moving the release from the locked position to the unlocked position by moving the release within the housing in a radially inward direction of the container; and then moving the release within the housing in a axially upward direction of the container. The method further includes moving the lid from the closed position to the opened position.

DETAILED DESCRIPTION OF THE PREFERRED EMBODIMENTS

Figure 1:
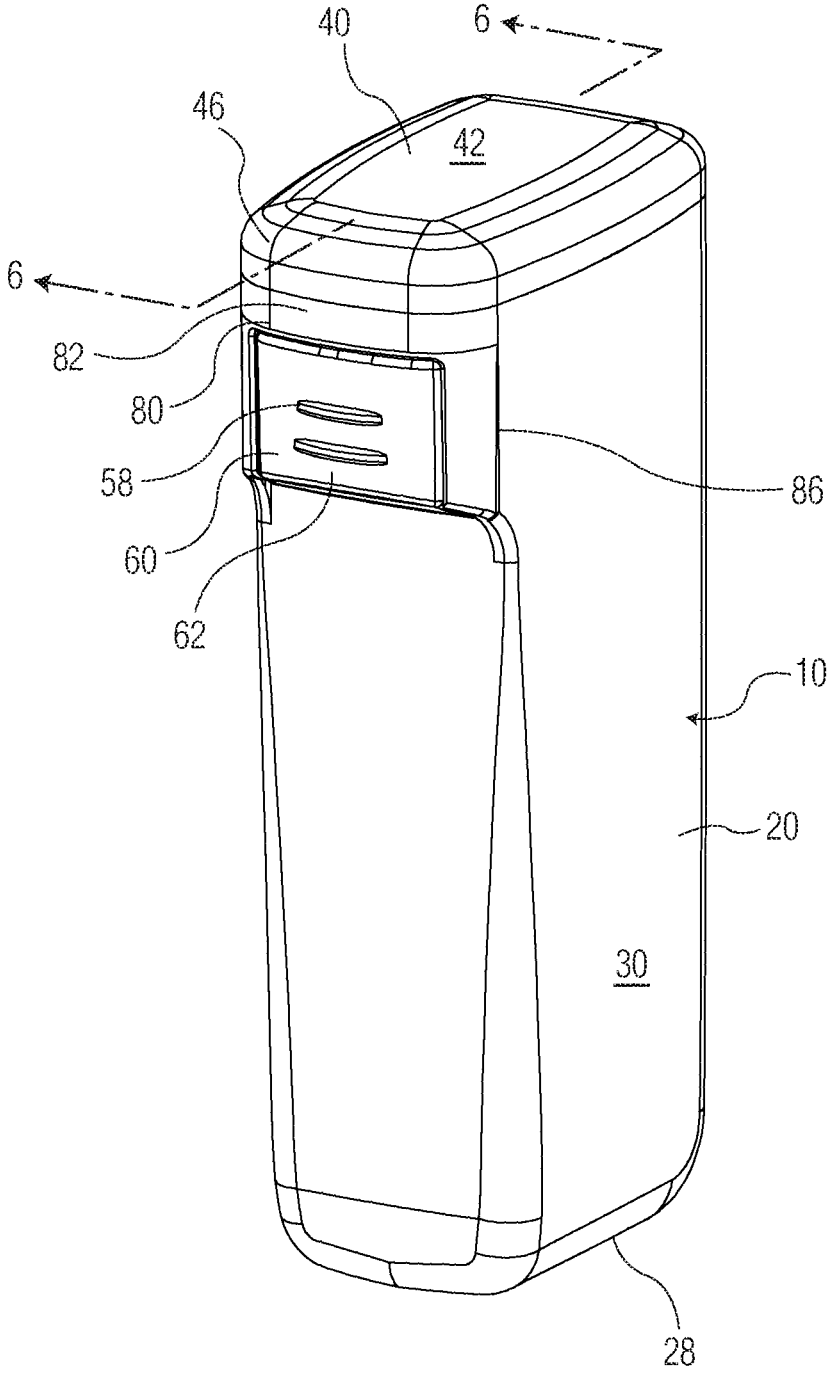
FIG. 1 is a front perspective view of a first embodiment of a container according to the invention, in a closed position and with a release in a locked position.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

Figure 2:
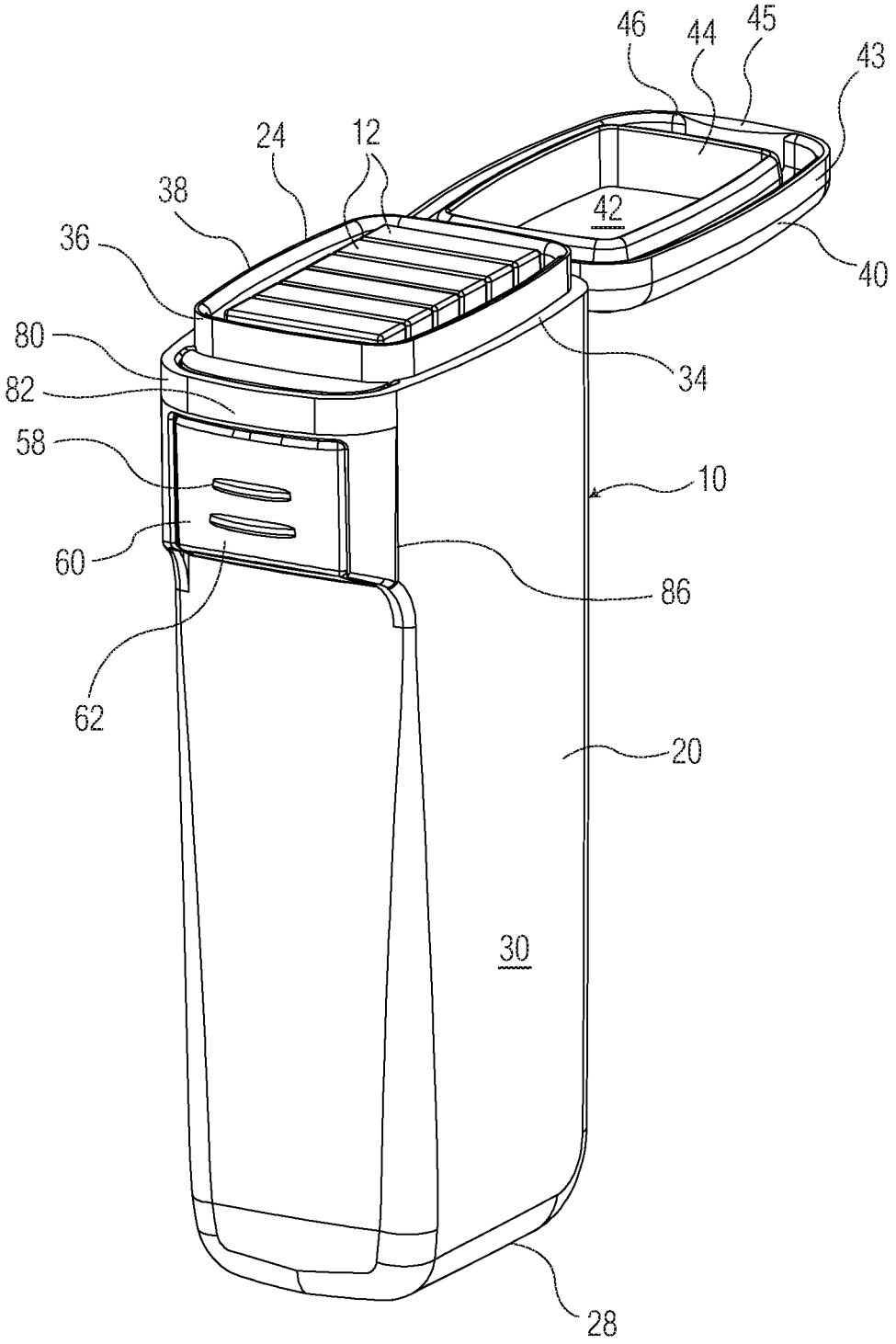
FIG. 2 is a front perspective view of the container of FIG. 1, in an opened position and with the release in the locked position.
Figure 4:
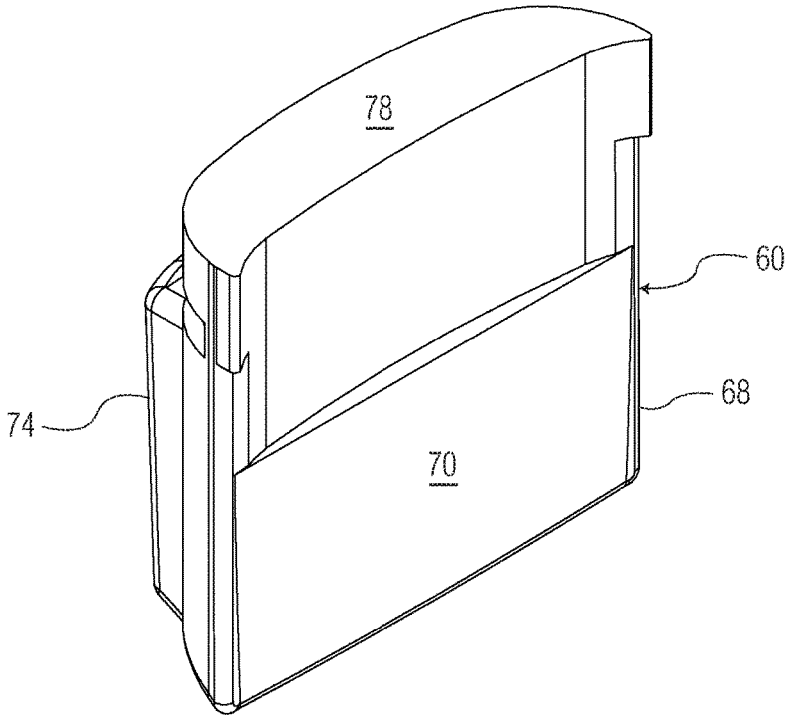
FIG. 4 is a rear perspective view of the release of the container of FIG. 1.
Figure 5:
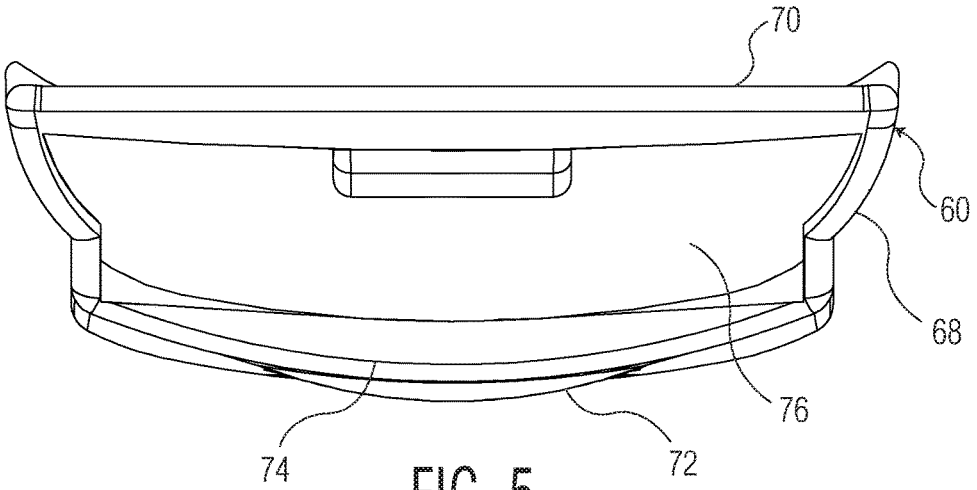
FIG. 5 is a bottom plan view of the release of the container of FIG. 1.
Figure 6:
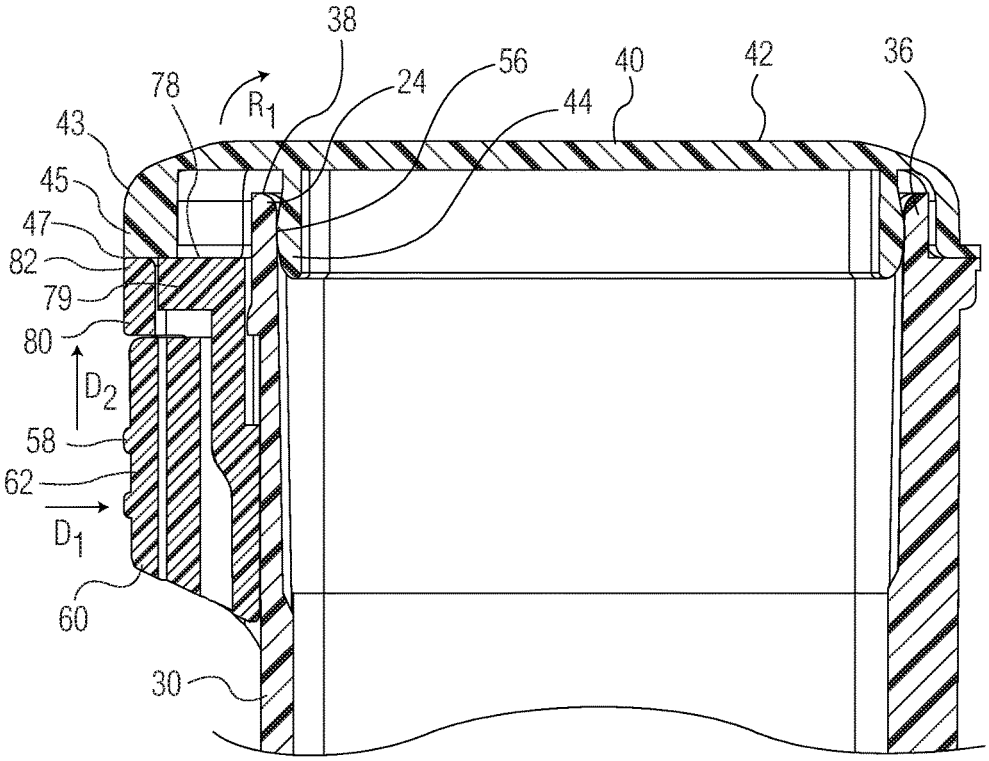
FIG. 6 is a partial cross section taken along line 6-6 of FIG. 1.
Figure 7:
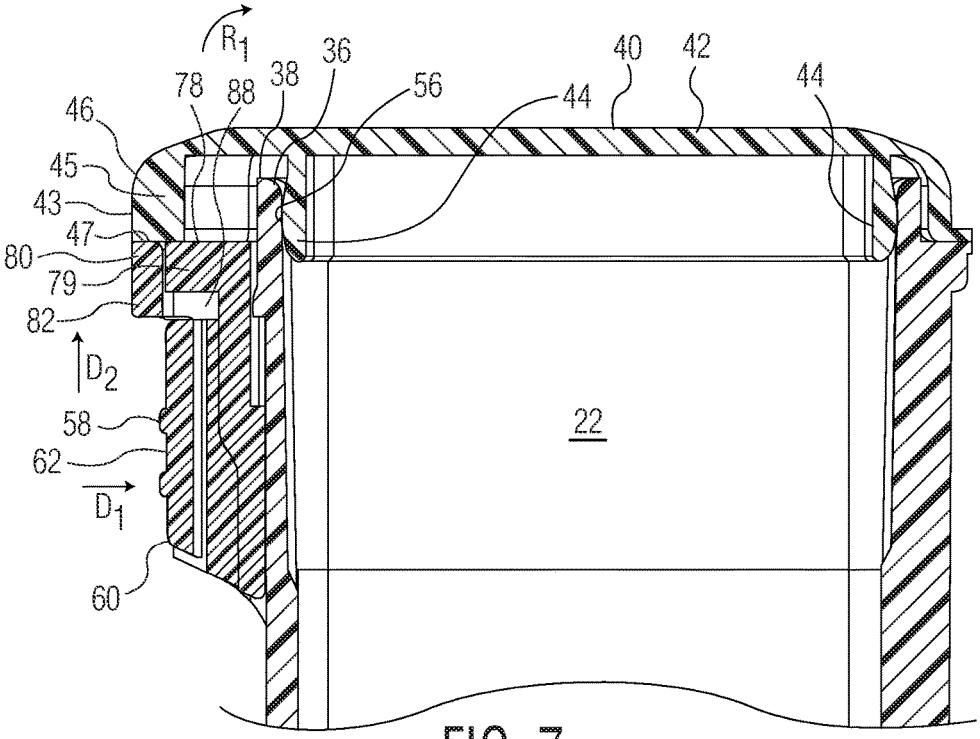
FIG. 7 is a partial cross section of the container as shown in FIG. 6, in the closed position and with the release in the unlocked position.

FIGS. 1-11 show an embodiment of a container assembly 10 according to the invention. The container 10 may be, as in the example shown, a vial, for storing products such as pharmaceutical products, tobacco products, confections, or other food products. As shown, the container 10 includes a container body 20 having an interior 22 for housing a plurality of products 12 therein. The container body 20 defines an opening 24 leading to the interior 22. The container 10 further includes a lid 40 configured to cover the opening 24, the lid 40 being movable with respect to the container body 20 to move the container 10 between a closed position in which the opening 24 is covered by the lid 40, as shown in FIGS. 1 and 6, and an opened position in which the opening 24 is exposed, as shown in FIG. 2. In the illustrated embodiment, the lid 40 is attached to the container body 20 by a hinge 26, such that the lid 40 is pivotably affixed to the body 20 to move the container 10 between the opened and closed positions. The container 10 further includes a release 60 and a release housing 80 affixed to a portion of the container body 20. The release 60 is movable within the release housing 80 between a locked position, as shown in FIGS. 1, 2 and 6, which retains the lid 40 in the closed position, and a unlocked position, as shown in FIG. 7, in which the release 60 disengages the lid 40 from the container body 20 to permit movement of the lid 40 from the closed position to the opened position.

The container body 20 includes a bottom wall 28 and tubular side wall 30 extending upward from the bottom wall 28, about the outer edges thereof. The bottom wall 28 and side wall 30 define the interior 22. An inward step 34 is formed near the top edge of the side wall 30. The step 34 defines an upwardly extending rim 36 of the side wall 30 that extends to the top of the container body 20 and forms the upper edge of the side wall 30.

Figure 10:
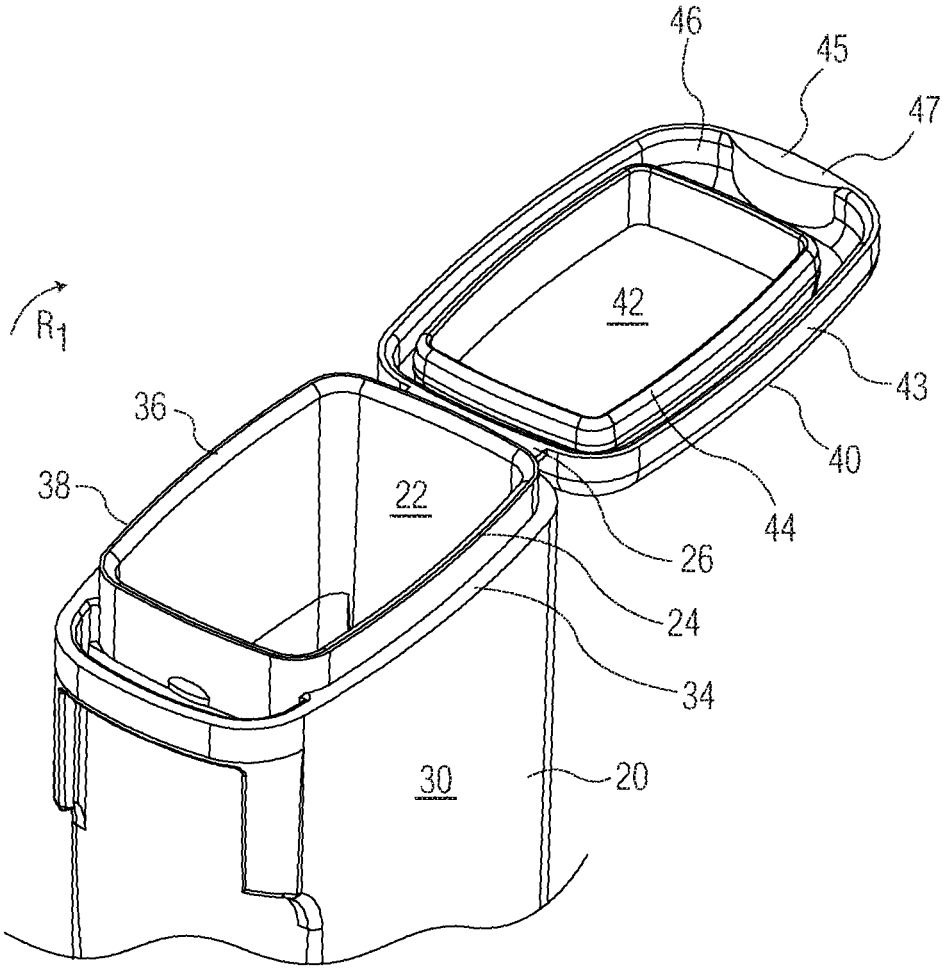
FIG. 10 is an enlarged front perspective view of the container of FIG. 1, with the release removed.
Figure 11:
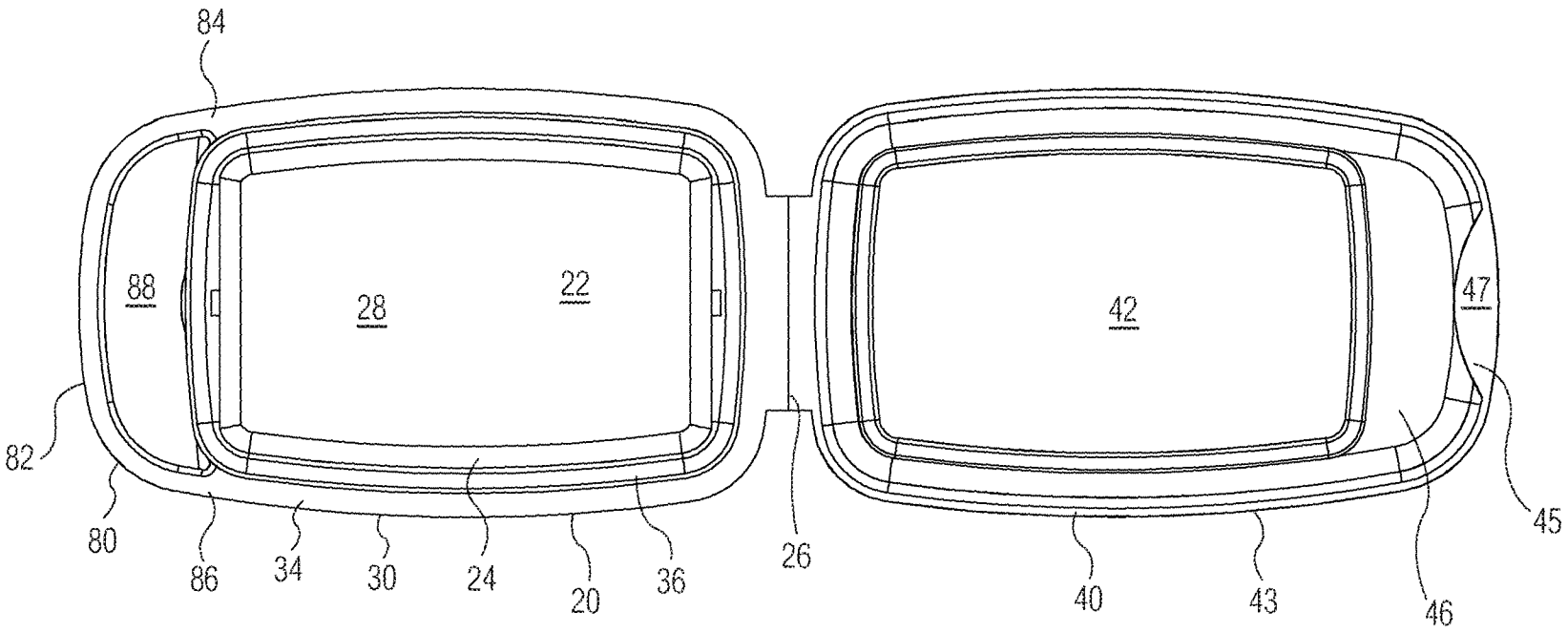
FIG. 11 is a top plan view of the container of FIG. 1, with the release removed.

The lid 40 is shown in detail in FIGS. 10 and 11. As shown, the lid 40 includes a substantially planar base wall 42 configured to cover the container body opening 24 when the container 10 is in the closed position. An inner seal 44 extends downward from a bottom surface of the base wall 42. The seal 44 may include an outwardly curved projection 56 on an outer surface thereof, formed towards the bottom portion of the seal 44 in the illustrated embodiment. When the container 10 is in the closed position, the inner seal 44 extends into the container body side wall 30, as can be seen in FIG. 6. As shown, the outer surface, and in particular the projection 56 of the seal 44 contacts the inner surface of side wall 30, to form a seal between the side wall 30 and the seal 44. Frictional engagement between the outer surface of the seal 44, and in particular the projection 56 thereof, and the inner surface of the side wall 30, forming an interference fit therebetween, retains the container 10 in the closed position.

Alternatively, the seal may be, for example, of the type disclosed in U.S. Pat. Nos. 7,537,137; 7,213,720 or 8,528,778, each of which is incorporated herein by reference as if fully set forth.

A moisture tight seal may be formed between the container body 20 and the lid 40, for example, by way of the above-described engagement between the container body 20 and the seal 44. As used herein, the term "moisture-tight" is defined as indicating that the moisture ingress of the container (after three days) was less than about 1500 micrograms of water, in another embodiment, about 500 micrograms of water, in a further embodiment, about 300 micrograms of water, in yet another embodiment, about 150 micrograms of water, determined by the following test method: (a) place one gram plus or minus 0.25 grams of molecular sieve desiccant in the container and record the weight; (b) fully close the container; (c) place the closed container in an environmental chamber at conditions of 80% relative humidity and 72 F; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

A skirt 43 extends downwardly from the base wall 42, about an outer perimeter thereof. The skirt 43 surrounds the rim 36 and rests on the step 34 when the container 10 is in the closed position, as shown in FIG. 6. As shown, the outer surface of the skirt 43 is flush with or inwardly disposed with respect to the outer surface of the side wall 30.

A front portion 46 of the lid 40 is formed as an extension of the base wall 42 and skirt 43 and extends from the front of the lid 40, at a location opposite the hinge 26 in the embodiment shown. The front portion 46 is substantially continuous with the base wall 42 and skirt 43, and is configured to extend over the release housing 80 when the container 10 is in the closed position. As best shown in FIGS. 2 and 10, a thickened region 45 of skirt 43 is formed in the front portion 46 of the lid 40. The thickened region 45 has a thickness that increases in an inwardly curved fashion with respect to the remaining portions of the skirt 43, forming a substantially horizontal lower surface 47 of the thickened region 45. As shown in FIG. 6, the skirt 43 portion of front portion 46 is substantially flush with or disposed slightly inward with respect to the outer surface of release housing 80 when the container 10 is in the closed position so that the lower surface 47 faces an upper side of the release housing 80, and the bottom of the entire front portion 46 is generally inaccessible to a user when the container 10 is in the closed position, and cannot be accessed to open the container 10 except by using the release 60 in the manner described below. Likewise, the lid 40 preferably has an outer perimeter that is slightly less than, i.e., disposed radially inward with respect to that of the side wall 30, making the entire lower side of the lid 40 inaccessible to prevent opening of the container 10 by means other than use of the release 60 in the manner described below.

The release housing 80 extends from the front of the container 10, out from the side wall 30 at an upper portion thereof. As shown, for example, in FIG. 11, the release housing 80 includes a bridge wall 82 that attaches to the container body side wall 30 at opposite ends 84, 86 thereof. As shown, for example in FIG. 10, a first end 84 of the bridge wall 82 joins the side wall 30 along an edge defined by the first end 84, the edge extending in a generally axial direction of the container body 20. The bridge wall 82 extends out from the side wall 30 in a curved path, and again joins with the side wall 30 along an edge defined by the second end 86, the edge extending in a generally axial direction of the container body. Accordingly, a housing space 88 is defined between the side wall 30, bridge wall 82, and first and second ends 84, 86 at which the side wall 30 and bridge wall 82 connect. The housing space 88 is configured to slidably house the release 60, as shown in FIGS. 1 and 6-9. The housing space 88 may be configured to permit sliding of the release 60 in an axial direction of the container 10 within the housing space 80.

An upper opening 90 is defined at the top of the housing space 88, and a lower opening 92 is defined at the bottom of the housing space 88. The upper opening 90 is configured to permit passage of the uppermost portion of the release 60 therethrough, and the lower opening 92 is configured to permit passage of the lowermost portion of the release 60 therethrough. The upper opening 90 is defined substantially axially level with the upward facing surface of the step 34 of container body side wall 30, as shown in FIG. 2, and is positioned to be covered by the front portion 46 of the lid 40 when the container 10 is in the closed position, with the thickened portion 45 of skirt 45 sitting directly above the upper opening 90. The lower opening 92 may extend in a path configured to accommodate the release button 62, allowing the button 62 to protrude outward from the opening, for example in a substantially three sided squared path, extending upward toward the top of the container 10, horizontally, then downward towards the bottom of the container 10, in order to accommodate and expose the substantially rectangular shaped button 62, as shown in FIGS. 1 and 2, and described in further detail below. This feature may optionally be incorporated into any container embodiment disclosed herein or any other container embodiment that falls within the scope of the present invention.

Figure 3:
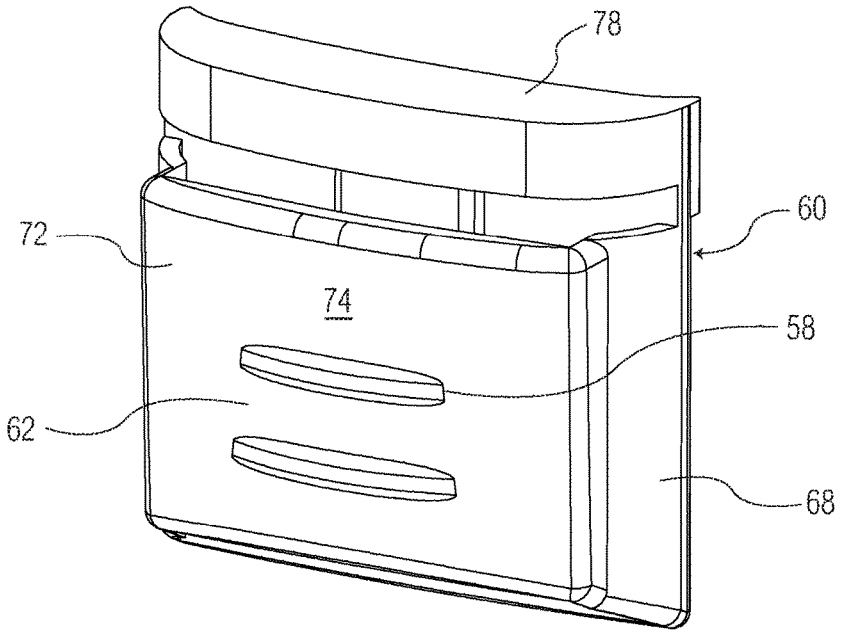
FIG. 3 is a front perspective view of the release of the container of FIG. 1.

FIGS. 3-5 show the release 60 in detail. As shown, the release 60 includes a body 68 having a substantially rectangular shape and a generally curved configuration to match the outer curvature of the container body side wall 30 and the inner curvature of the bridge wall 82. The release body 68 is configured to fit between the side wall 30 and the bridge wall 82, within the housing space 88 defined therebetween. The release 60 includes an inner side 70 that faces the container body 20 when disposed within the housing space 88, and an outer side 72 that faces away from the container body and in some areas towards the bridge wall 82 when disposed within the housing space 88.

Figure 8:
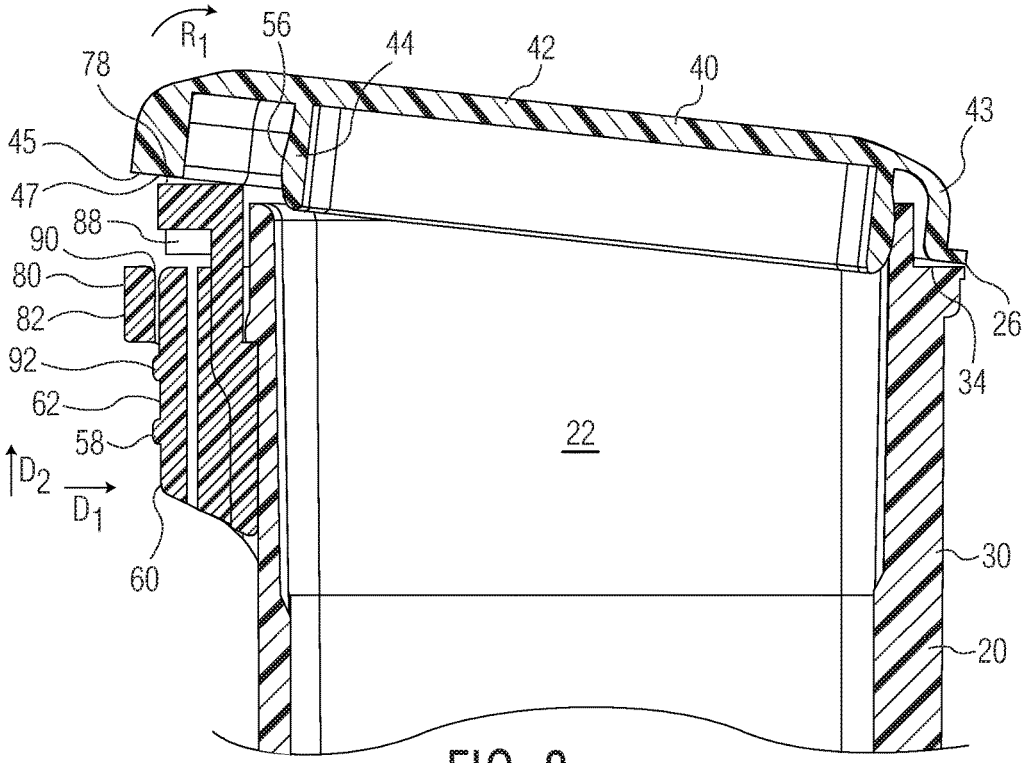
FIG. 8 is a partial cross section of the container as shown in FIG. 6, in the process of moving between the closed position and the opened position and with the release in the unlocked position.
Figure 9:
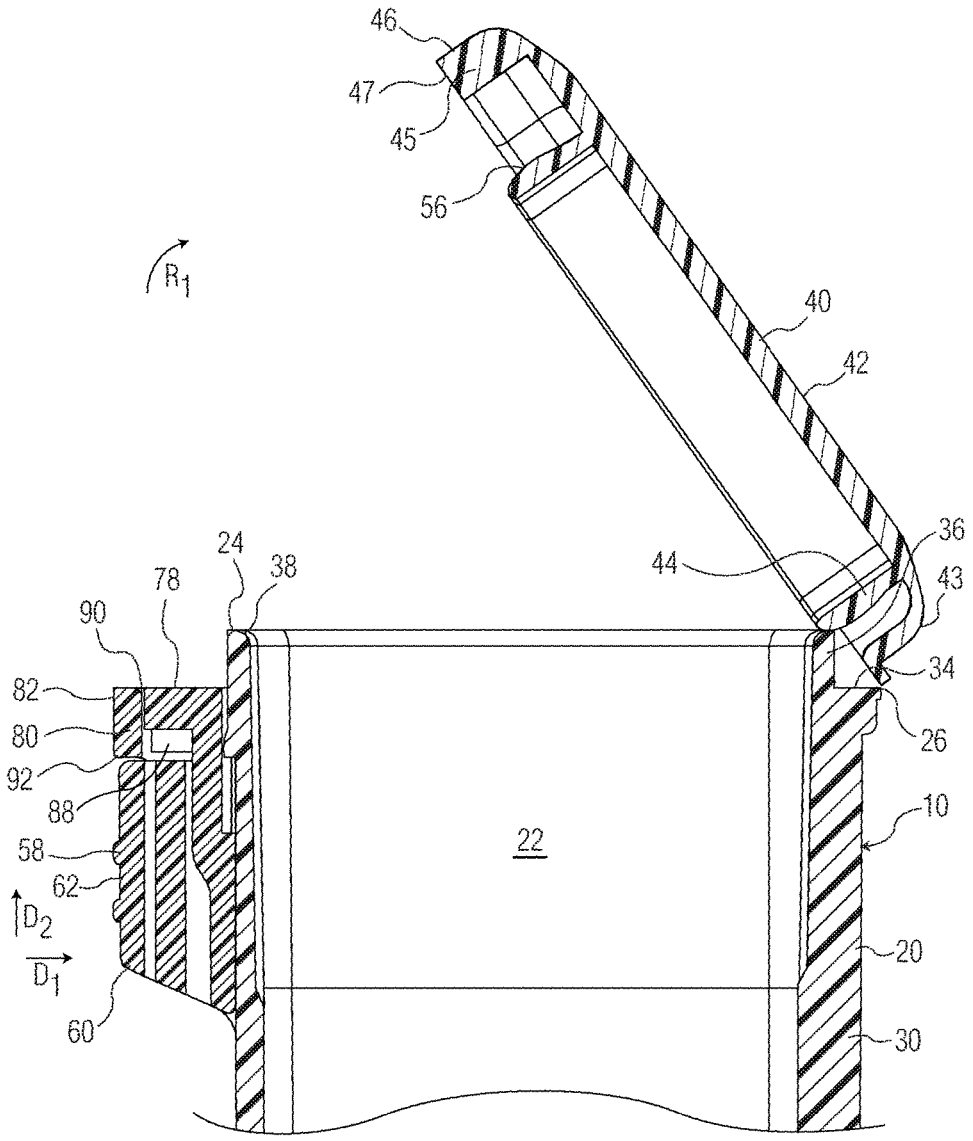
FIG. 9 is a partial cross section of the container as shown in FIG. 6, in an opened position and with the release in the locked position.

As best shown in FIG. 3, a button 62 is formed on the outer side 72 of release body 68. The button 62 formed as a front wall 74 that curves outward from release body 68 and attaches thereto at opposite sides thereof, forming a space 76 between the body 68 and the front wall 74 that defines the button 62. This arrangement permits the button 62 to be forced inward in direction D1 with respect to the release body 68, moving the button 62 into the space 76, and permitting the release 60 to be moved from a locked position, as shown in FIGS. 1, 2 and 9, to an unlocked position, as shown in FIGS. 7 and 8. The button 62 can be configured to bias the release towards the locked position, for example, by forming the button 62 and release body 68 as an integral unit, of material sufficiently stiff so as to resist deformation of the button in direction D1.

FIGS. 1, 2, 6 and 9 show the release 60 in the locked position. In this position, the button 62 protrudes from beneath the bridge wall 82, as shown in FIGS. 1-3, 8 and 9. An upper portion 79 of release body 68, located above the button 62, is held between the bridge wall 82 and the rim 36. The top surface 78 of the release 60 is located generally flush with the top edge 38 of the container body rim 36. The top surface 78 of release 60 abuts the bottom surface 47 of thickened portion of the lid skirt 43.

In order to move the container 10 from the closed position, shown in FIG. 1, to the opened position, shown in FIG. 2, the release 60 must be moved from the locked position, as shown in FIGS. 1, 2, 6 and 9, to the unlocked position, as shown in FIGS. 7 and 8. This is achieved by depressing the button 62 in direction D1, which is an inward, radial direction of the container 10, as shown in FIG. 7. This causes deformation of the release 60 and movement of the button 62 in direction D1. Once the button 62 has been sufficiently displaced in direction D1 so as to clear the bridge wall 82 of the release housing 80, it can be slid upwards, in an axial direction of the container 10, direction D2, as shown in FIG. 8, to the unlocked position. The top surface 78 of the upper portion 79 of the release 60, which is in contact with the bottom surface 47 of the thickened portion 45 of the skirt 43 when the container 10 is closed, pushes up on the front portion 46, which, due to its skirt 43 portion being flush with or inwardly disposed with respect to bridge wall 82, cannot otherwise be accessed by a user of the container 10. The upward driving of the front portion 46 by the release 60 causes disengagement of the seal projection 56 with the container side wall 30, and in turn disengagement of the lid 40 from the container body 20, and pivoting of the lid 40 in direction R1, resulting in opening of the container 10, as shown in FIGS. 8 and 9.

The button 62 may include finger grip 58, for example, an indentation or, as shown in the illustrated example, at least one ridge placed for engagement by the finger of a user, to facilitate movement of the release 80 from the locked position to the unlocked position.

Once pressure on the button 62 in direction D1 is released, the release 60, due to its bias toward the locked position, as described above, begins to return to the locked position, by the button 62 moving in the reverse direction of D1. This, in turn, urges the release downward, in the reverse direction of D2, so that the button 62 can clear the bridge wall 82 and move fully outward to its biased position. This returning action of the button 62 can occur when a user removes pressure from the button 62, and when the container 10 is in an opened position, as shown in FIG. 9, or when the container 10 is in a closed position, as shown in FIG. 6.

Figure 12:
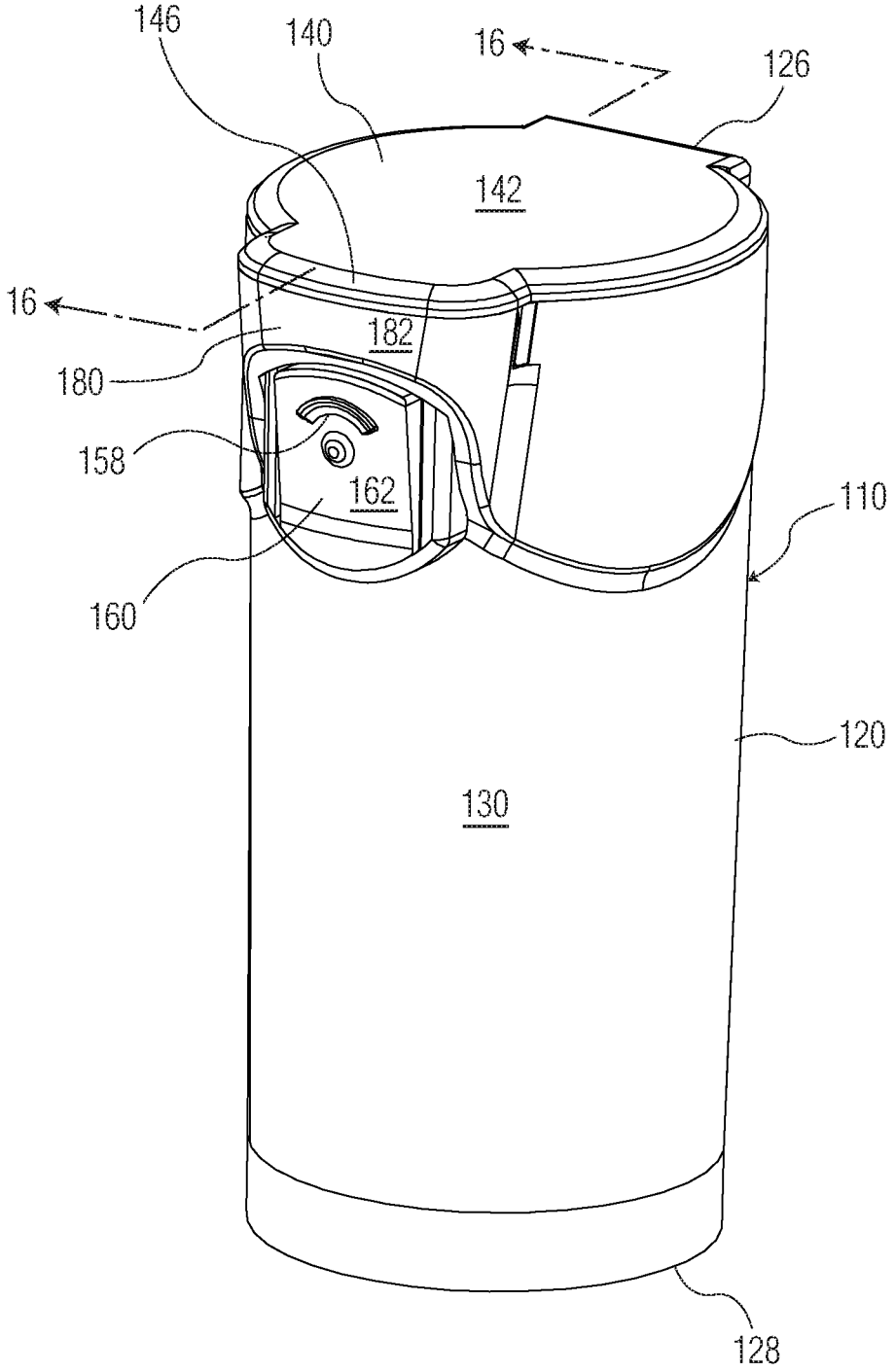
FIG. 12 is a front perspective view of a second embodiment of a container according to the invention, in a closed position and with a release in a locked position.
Figure 14:
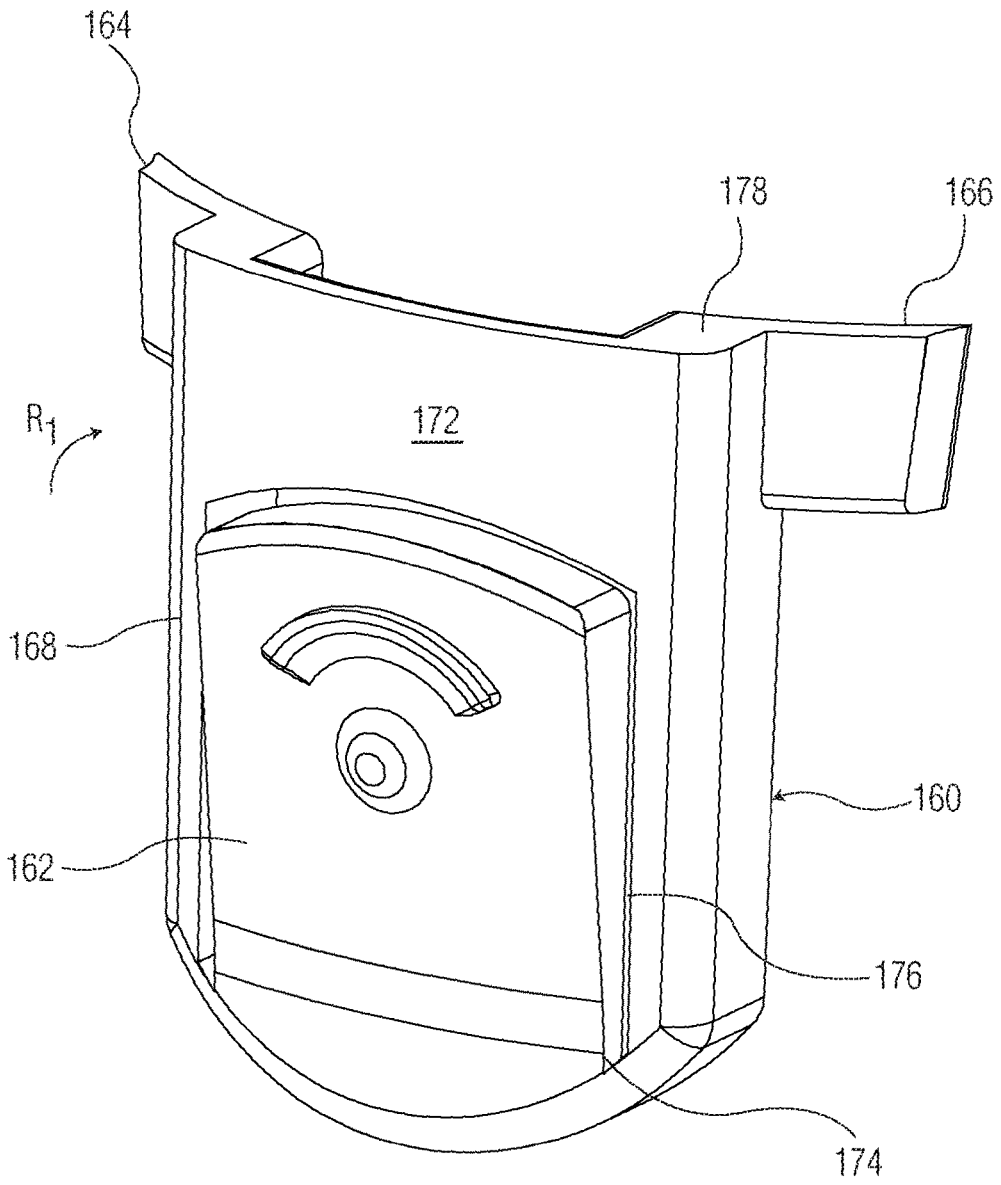
FIG. 14 is a front perspective view of the release of the container of FIG. 12.
Figure 15:
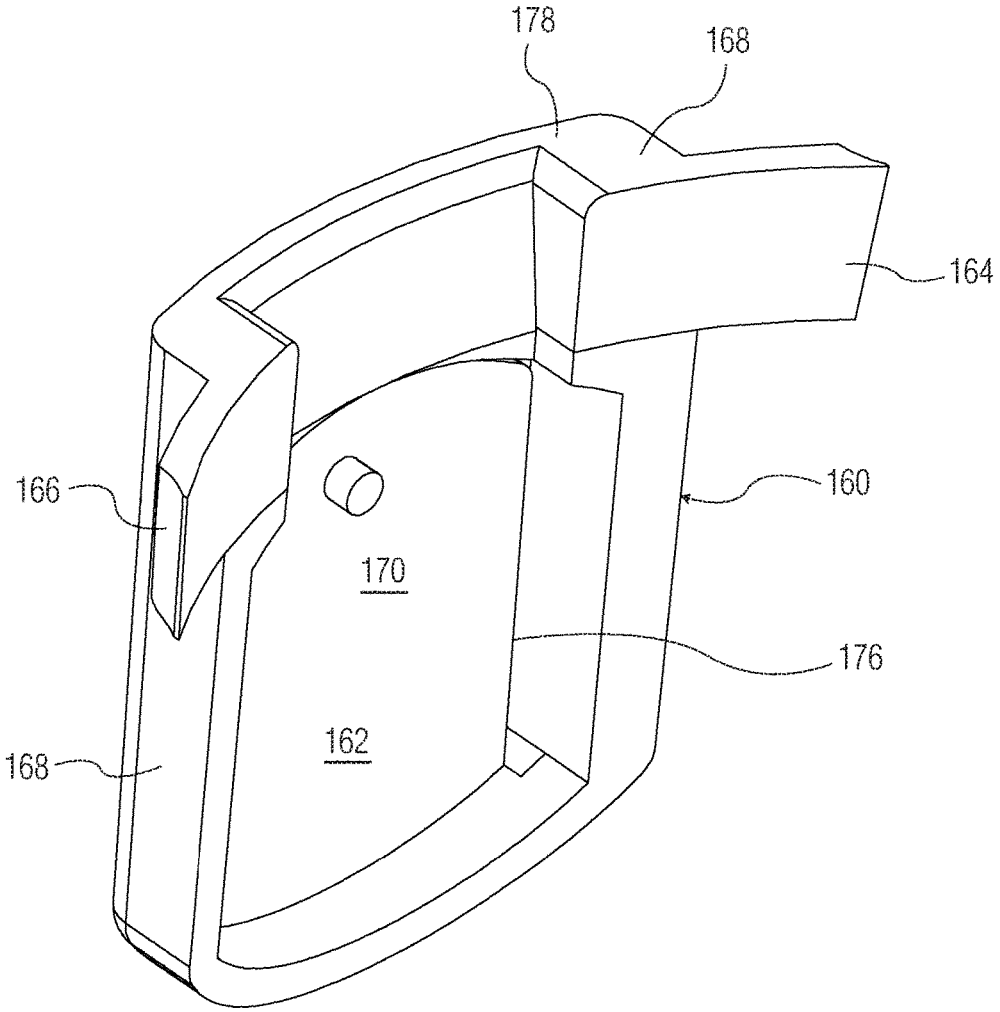
FIG. 15 is a rear perspective view of the release of the container of FIG. 12.
Figure 16:
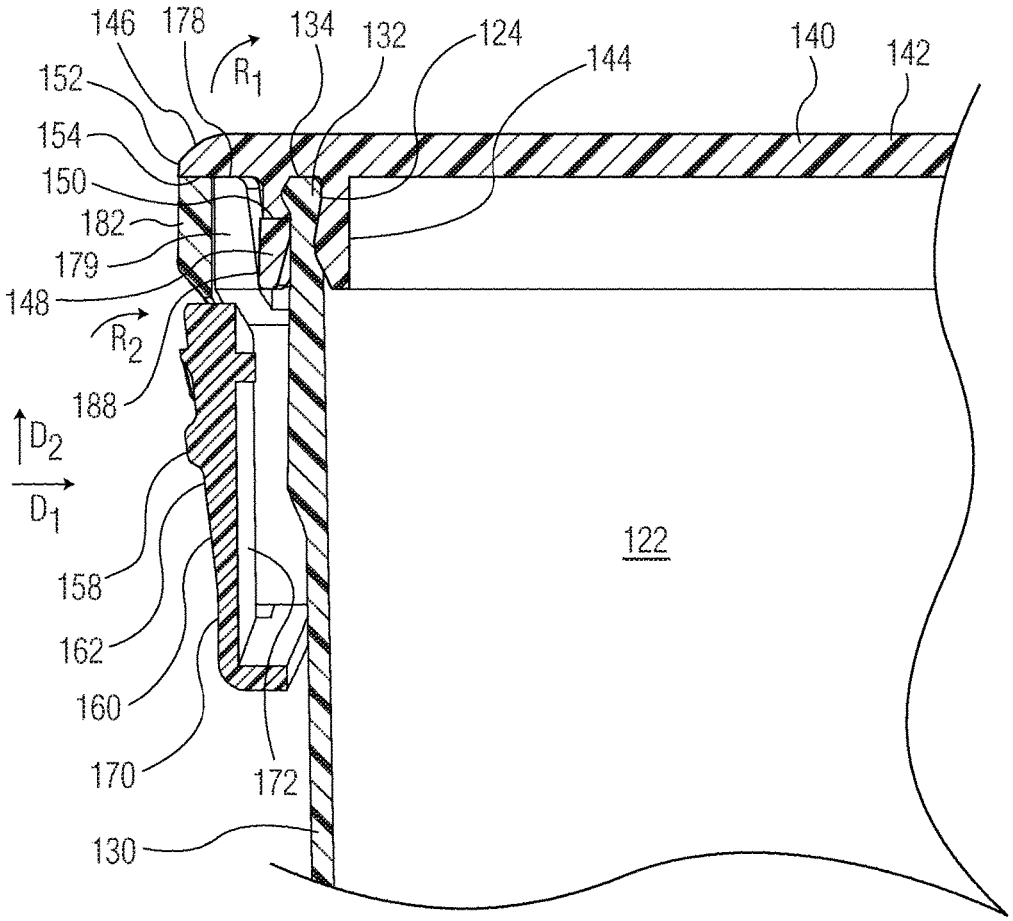
FIG. 16 is a partial cross section taken along line 16-16 of FIG. 12.
Figure 17:
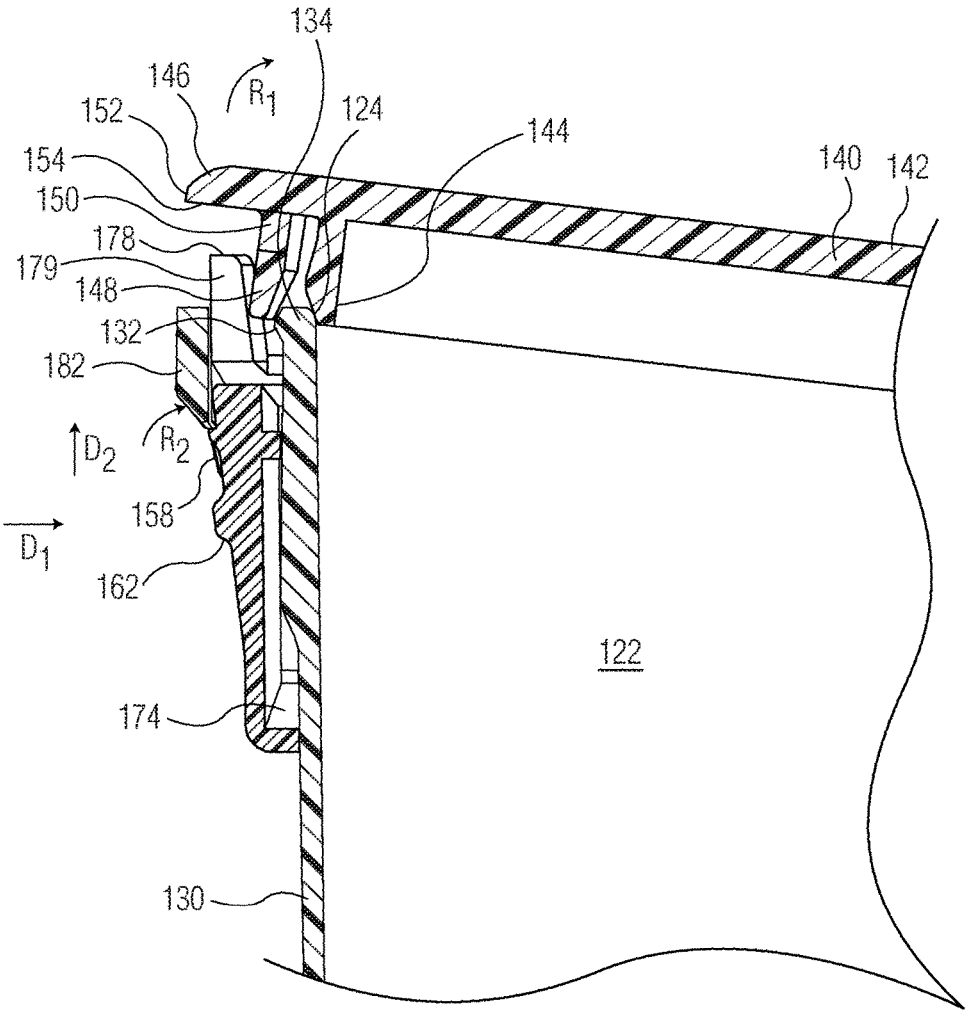
FIG. 17 is a partial cross section of the container as shown in FIG. 16, in the process of moving between the closed position and the opened position and with the release in the unlocked position.
Figure 18:
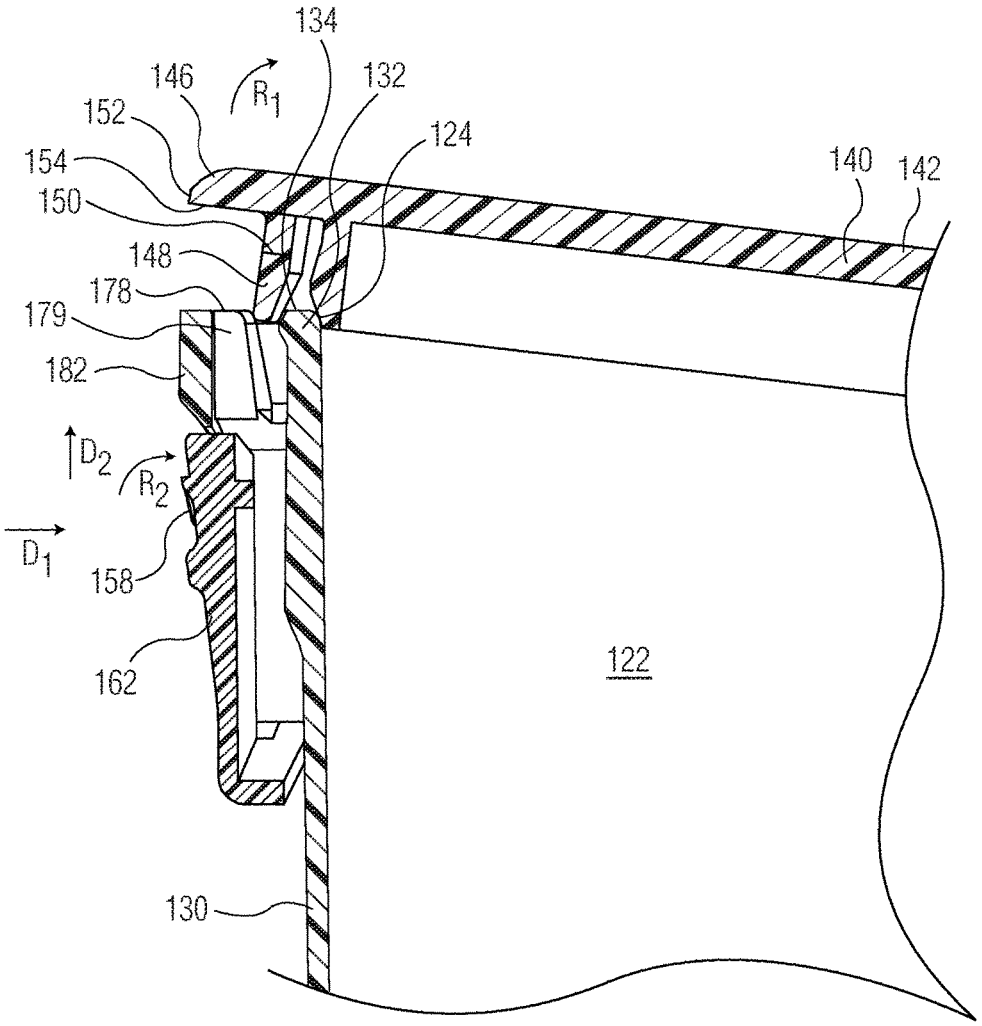
FIG. 18 is a partial cross section of the container as shown in FIG. 16, in an opened position and with the release in the locked position.

FIGS. 12-21 show a second embodiment of a container assembly 110 according to the invention. The container 110 may be, as in the example shown, a vial, for storing products such as pharmaceutical products, tobacco products, confections, or other food products. As shown, the container 110 includes a container body 120 having an interior 122 for housing a plurality of products 112 therein. The container body 120 defines an opening 124 leading to the interior 122. The container 110 further includes a lid 140 configured to cover the opening 124, the lid 140 being movable with respect to the container body 120 to move the container 110 between a closed position in which the opening 124 is covered by the lid 140, as shown in FIGS. 12 and 16, and an opened position in which the opening 124 is exposed, as shown in FIG. 18. In the illustrated embodiment, the lid 140 is attached to the container body 120 by a hinge 126, such that the lid 140 is pivotably affixed to the body 120 to move the container 110 between the opened and closed positions. The container 110 further includes a release 160 and a release housing 180 affixed to a portion of the container body 120. The release 160 is movable within the release housing 180 between a locked position, as shown in FIGS. 12, 13, 16 and 18, which retains the lid 140 in the closed position, and an unlocked position, as shown in FIG. 17, in which the release 160 disengages the lid 140 from the container body 120 to permit movement of the lid 140 from the closed position to the opened position.

The container body 120 includes a bottom wall 128 and tubular side wall 130, which is substantially cylindrical in the embodiment shown, and extends upward from the bottom wall 128, about the outer edges thereof. The bottom wall 128 and side wall 130 define the interior 122. An engagement ridge 132 may be formed at an upper edge of the side wall 130, at a front portion of the container body 120 to engage the lid 140 with the container body 120, to retain the container 110 in the closed position, as described in detail below.

Figure 19:
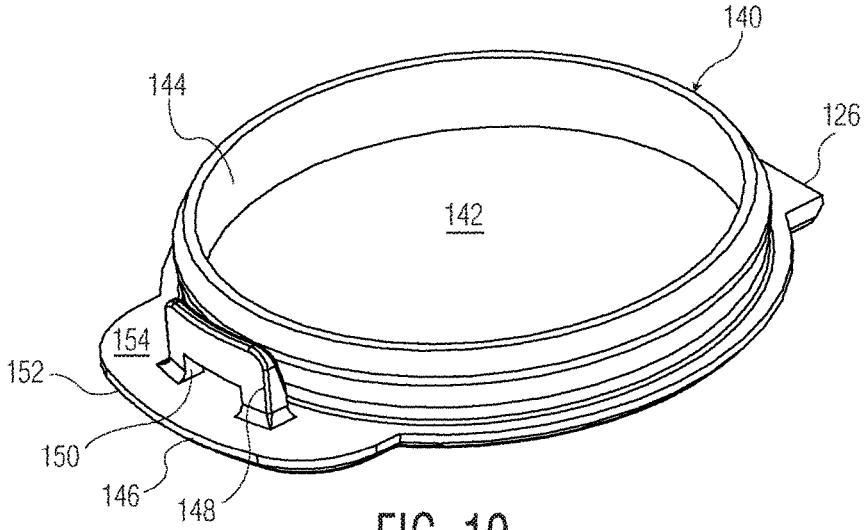
FIG. 19 is a bottom, front perspective view of the lid of the container of FIG. 12.

The lid 140 is shown in detail in FIG. 19. As shown, the lid 140 includes a substantially planar base wall 142 configured to cover the container body opening 124 when the container 110 is in the closed position. An inner seal 144 extends downward from a bottom surface of the base wall 142. When the container 110 is in the closed position, the inner seal 144 extends into the container body side wall 130, as can be seen in FIG. 16. As shown, the outer surface of the seal 144 contacts the inner surface of side wall 130, to form a seal between the side wall 130 and the seal 144.

The seal 144 may be, for example, of the type disclosed in U.S. Pat. Nos. 7,537,137; 7,213,720 or 8,528,778.

A moisture tight seal may be formed between the container body 120 and the lid 140, for example, by way of the above-described engagement between the container body 120 and the seal 144.

A tab 146 extends from the front of the lid 140, at a location opposite the hinge 126 in the embodiment shown. The tab 146 is substantially planar, and substantially coplanar with the base wall 142, such that the tab 146 forms a forward extension of the base wall 142. The tab 146 is configured to extend over the release housing 180 when the container 110 is in the closed position, and to have an end 152 that is flush with or disposed slightly inward with respect to the outer surface of release housing 180 when the container is in the closed position, so that the bottom surface 154 of the tab 146 faces an upper side of the release housing 180 and is generally inaccessible to a user when the container 110 is in the closed position, and cannot be used to open the container 110 except by using the release 160 in the manner described below. Likewise, the lid 140 preferably has an outer perimeter that is slightly less than, i.e., disposed radially inward with respect to that of the side wall 130, making the entire lower side of the lid 140 inaccessible to prevent opening of the container 110 by means other than use of the release 160 in the manner described below.

Figure 13:
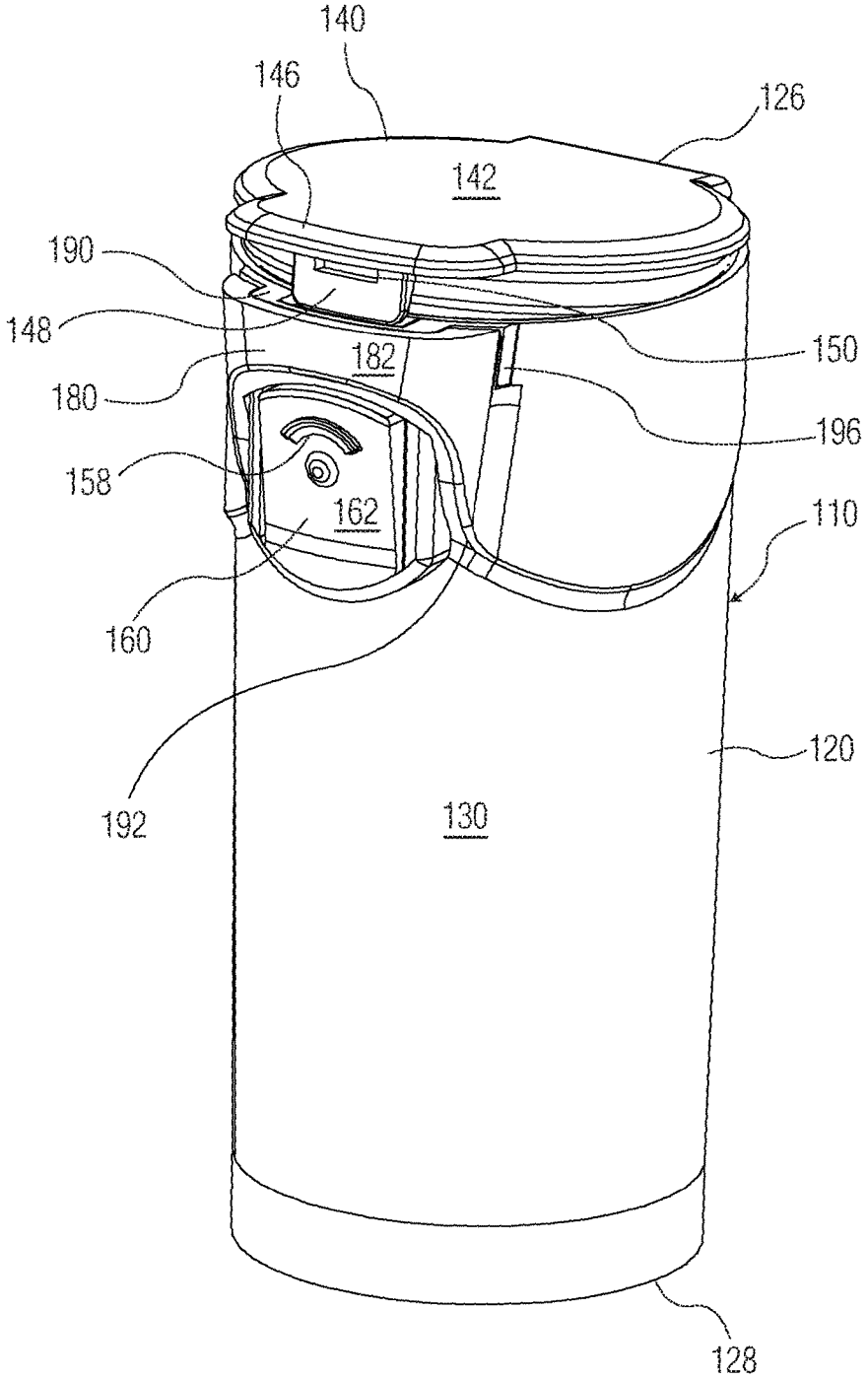
FIG. 13 is a front perspective view of the container of FIG. 12, in an opened position and with the release in a locked position.

A guide 148 extends downward from a lower surface of the tab 146. As shown in FIGS. 13, 16 and 17, the guide 148 engages the outer surface of the side wall 130 and the engagement ridge 132 formed thereon, when the container 110 is in the closed position. A slit 150 is formed between the guide 148 and the lower surface of the tab 146, extending along the top edge of the guide 148, where the guide joins with the tab 146. As shown in FIG. 16, the engagement ridge 132 extends into the slit 150 when the container 110 is in the closed position, to form an interlocking configuration between the slit 150 and the engagement ridge 132, to help to retain the container 110 in the closed position.

Figure 20:
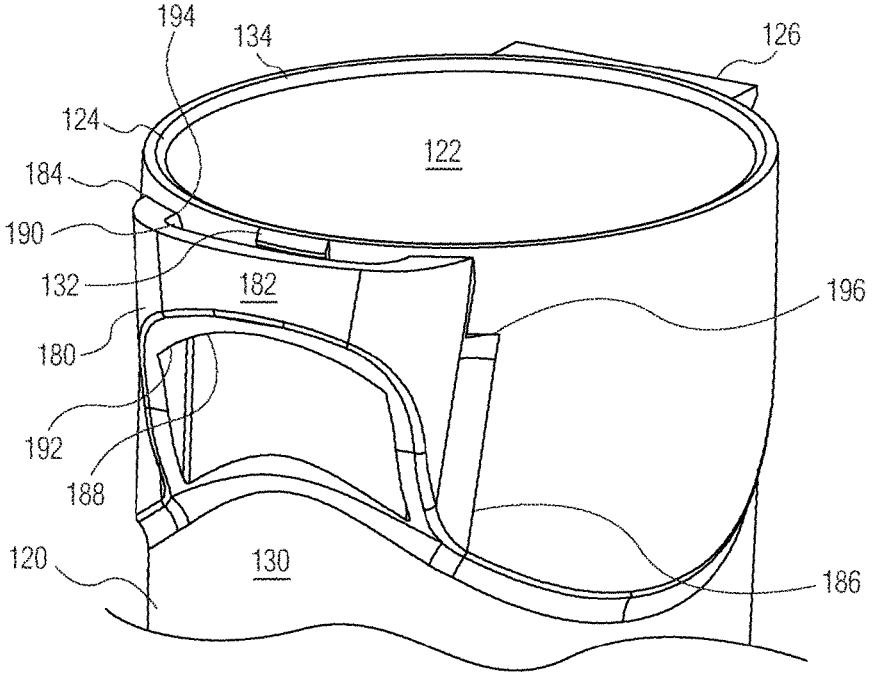
FIG. 20 is an enlarged front perspective view of the container of FIG. 12, with the release and lid removed.

The release housing 180 extends from the front of the container 110, out from the side wall 130 at an upper portion thereof. As shown, for example, in FIG. 20, the housing 180 includes a bridge wall 182 that attaches to the container body side wall 130 at opposite ends 184, 186 thereof. As shown, for example in FIG. 20, a first end 184 of the bridge wall 182 joins the side wall 130 along an edge defined by the first end 184, the edge extending in a generally axial direction of the container body 120. The bridge wall 182 extends out from the side wall 130 in a curved path, and again joins with the side wall 130 along an edge defined by the second end 186, the edge extending in a generally axial direction of the container body. Accordingly, a housing space 188 is defined between the side wall 130, bridge wall 182, and first and second ends 184, 186 at which the side wall 130 and bridge wall 182 connect. The housing space 188 is configured to slidably house the release 160, as shown in FIGS. 1, 2 and 16-18. The housing space 188 may be configured to permit sliding of the release 160 in an axial direction of the container 110 within the housing space 180. An upper opening 190 is defined at the top of the housing space 188, and a lower opening 192 is defined at the bottom of the housing space 188. The upper opening 190 is configured to permit passage of the uppermost portion of the release 160 therethrough, and the lower opening 192 is configured to permit passage of the lowermost portion of the release 160 therethrough. The upper opening 190 is defined substantially axially level with, or close to the upper edge of container body side wall 130, as shown in FIG. 20, and is positioned to be covered by tab 146 when the container 110 is in the closed position. The lower opening 192 may extend in an arced path, towards the container lid 130, as it transverses between ends 184, 186, so as to expose the release button 162, as shown in FIGS. 12 and 13, and described in further detail below.

Figure 21:
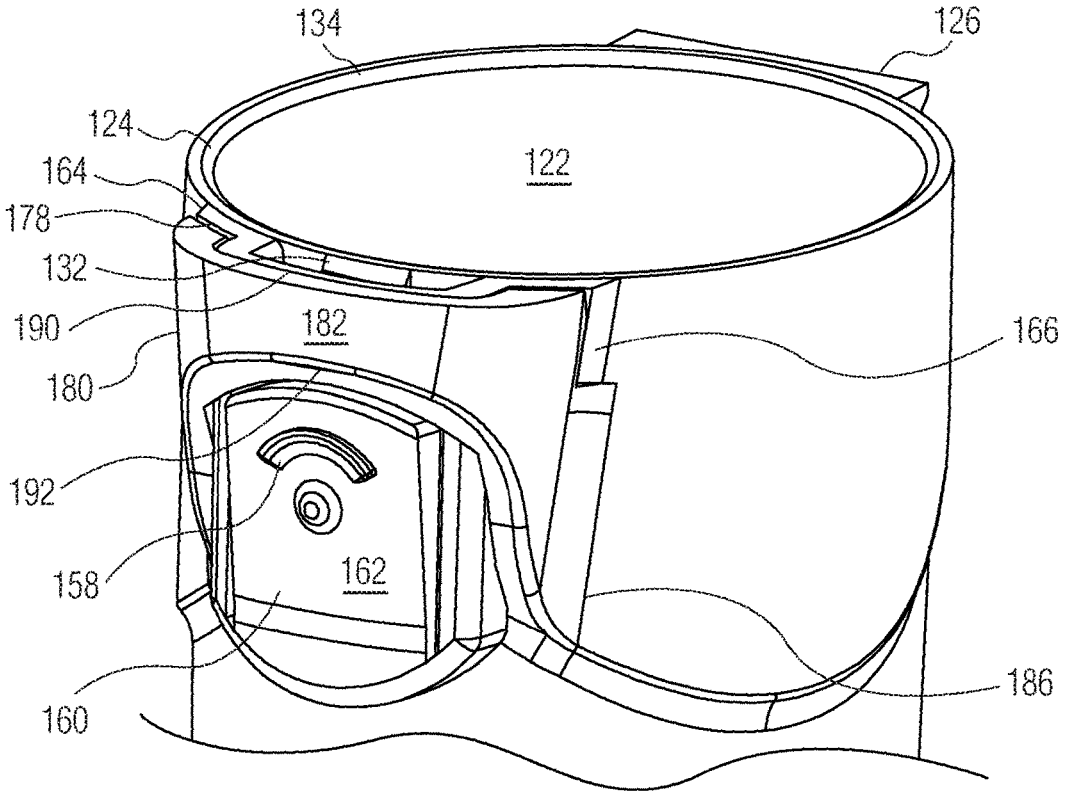
FIG. 21 is an enlarged front perspective view of the container of FIG. 12, with the lid removed.

As shown, for example, in FIGS. 20 and 21, notches 194, 196 are cut into the bridge wall 182, at the corners thereof formed between upper opening 190 and each of the ends 184, 186. Notches are rectangular in the embodiment shown, and are configured to receive arms 164, 166 of the release button 160.

FIGS. 14 and 15 show the release 160 in detail. As shown, the release 160 includes a body 168 having a generally curved configuration to match the outer curvature of the container body side wall 130 and the inner curvature of the bridge wall 182. The release body 168 is configured to fit between the side wall 130 and the bridge wall 182, within the housing space 188 defined therebetween. The release 160 includes an inner side 170 that faces the container body 120 when disposed within the housing space 188, and an outer side 172 that faces away from the container body and in some areas towards the bridge wall 182 when disposed within the housing space 188.

As best shown in FIG. 14, a button 162 is formed on the outer side 172 of release body 168. The button 162 is attached to release body 168 along an axis 174 that extends along the bottom edge of the button 162. A slot 176 traverses the side and upper edges of the button 162, separating the button 162 from the surrounding portions of the release body 168. This arrangement permits the button to pivot in direction R2 with respect to the release body 168, to move the release 160 between a locked position, as shown in FIGS. 12, 13, 16, and 18, and an unlocked position, as shown in FIG. 17. The button 162 may biased the release 160 towards the locked position, for example, by forming the button 162 and release body 168 as an integral unit, of material sufficiently stiff so as to resist pivoting of the button in direction R2.

FIGS. 12, 13, 16, and 18 show the release 160 in the locked position. In this position, the button 162 protrudes from beneath the bridge wall 182. An upper portion 179 of release body 168, located above the button 162, is held between the bridge wall 182 and the guide 148. The arms 164, 166 are located within notches 194, 196, and the top edge 178 of the release 160 is located generally flush with the top edge 134 of container body side wall 130. The top edge 178 of release abuts the bottom surface 154 of lid tab 146.

In order to move the container 110 from the closed position, shown in FIGS. 12 and 16, to the opened position shown in FIGS. 17 and 18, the release 160 must be moved from the locked position, as shown in 12, 13, 16, and 18, to the unlocked position, as shown in FIG. 17. This is achieved by depressing the button 162 in direction D1, which is an inward, radial direction of the container 110, as shown in FIGS. 16 and 17. This causes inward pivoting of the button 162 in direction R2. Once the button 162 has been sufficiently displaced in direction R2 so as to clear the bridge wall 182 of the release housing 180, it can be slid upwards, in an axial direction of the container 110, direction D2, to the unlocked position as shown in FIG. 17. The top of the upper portion 179 of the release 160, which is in contact with the bottom surface 154 of the lid tab 146 when the container 110 is closed, pushes up on the tab 146, which, due to its end 152 being flush with or inwardly disposed with respect to bridge wall 182, cannot otherwise be accessed by a user of the container 110. The upward driving of the tab 146 by the release 160 causes disengagement of the engagement ridge 132 with the slit 150, and in turn disengagement of the lid 140 from the container body 120, and pivoting of the lid 140 in direction R1, resulting in opening of the container 110, as shown in FIG. 17.

The button 162 may include finger grip 158, for example, an indentation or, as shown in the illustrated example, a ridge placed for engagement by the finger of a user, to facilitate movement of the release 180 from the locked position to the unlocked position. Optionally, the finger grip 158 may include a textured surface (e.g., in the style of a pistol grip) to better enable a user's thumb or finger to adhere to the button 162 when depressing and vertically moving the button 162.

Once pressure on the button 162 in direction D1 is released, the release 160, due to its bias toward the locked position, as described above, begins to return to the locked position, by pivoting of the button 162 in the reverse direction of R2. This, in turn, urges the release 160 downward, in the reverse direction of D2, so that the button 162 can clear the bridge wall 182 and pivot fully outward to its biased position. This returning action of the button 162 can occur when a user removes pressure from the button 162, and when the container 110 is in an opened position as shown in FIGS. 17 and 18, or when the container 110 is in a closed position, as shown in FIG. 16.

Figure 22:
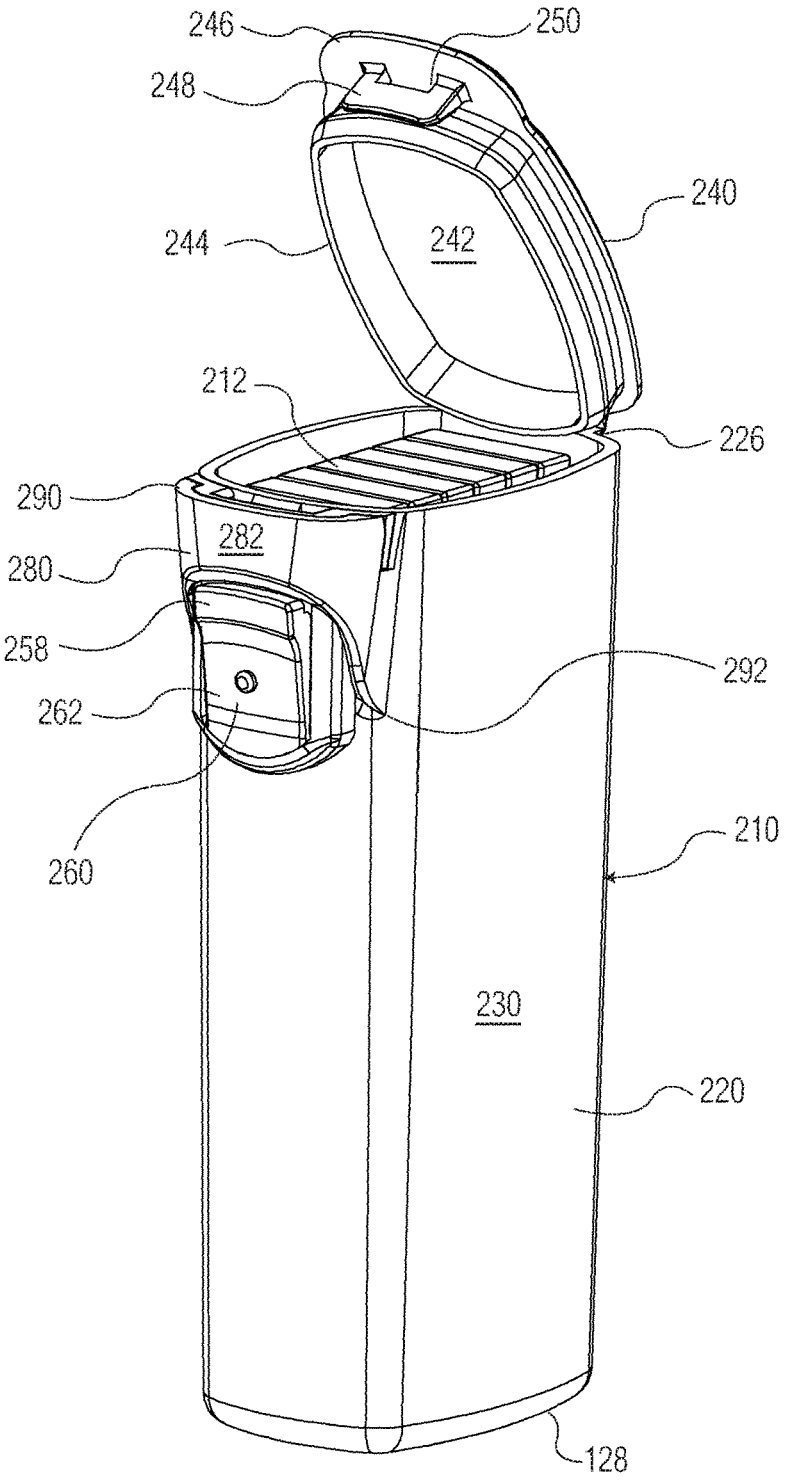
FIG. 22 is a front perspective view of a third embodiment of a container according to the invention, in an opened position and with a release in a locked position.
Figure 23:
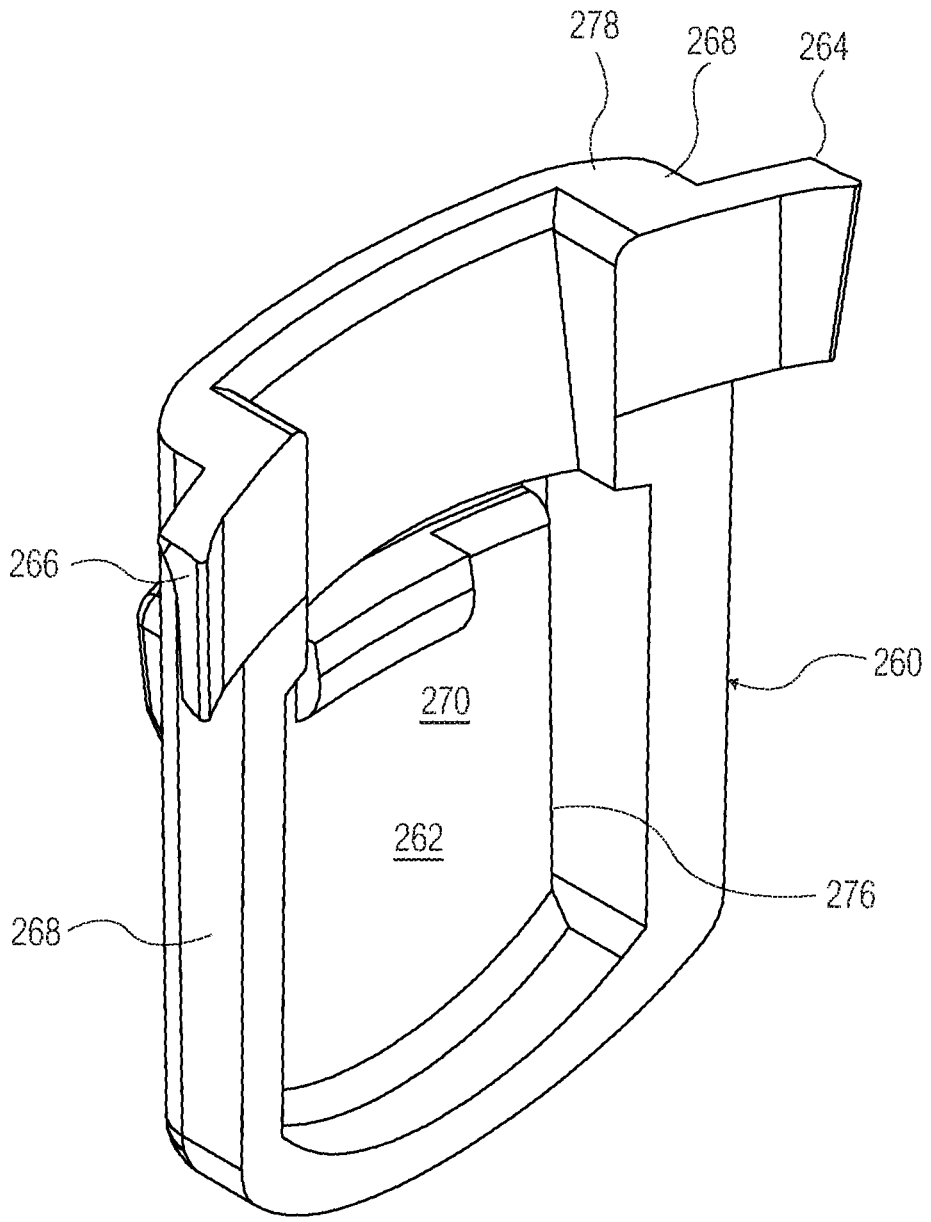
FIG. 23 is a rear perspective view of the release of the container of FIG. 22.

FIGS. 22 and 23 show a third embodiment of a container 210 according to the invention. The parts and functions thereof are the same as those of the container 110 shown in FIGS. 12-21, with only the shapes and appearances of the parts varying. Reference numbers of the parts of the container 210 corresponding to those of the embodiment of FIGS. 12-21 have been increased by 100.

Figure 24:
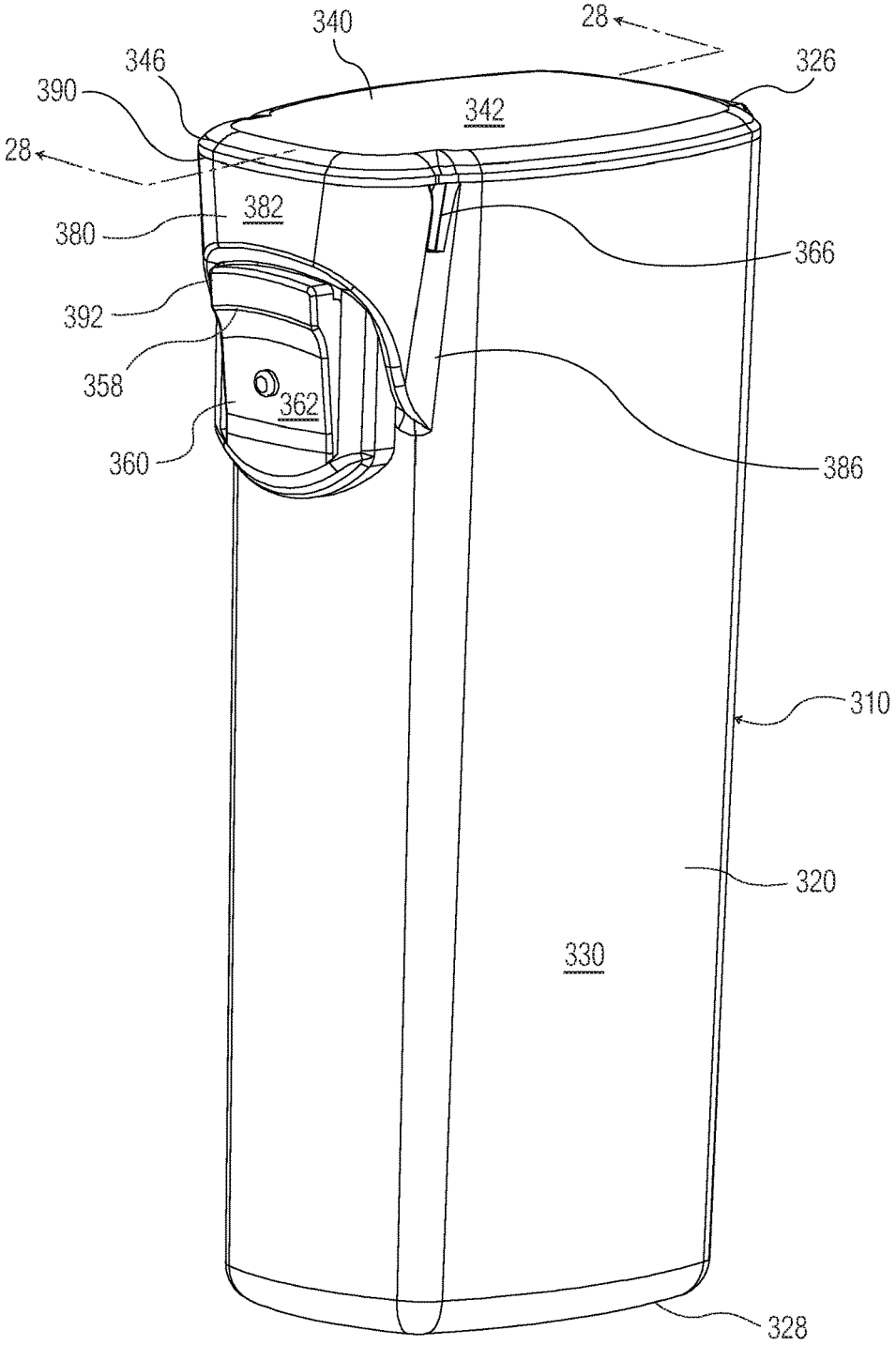
FIG. 24 is a front perspective view of a fourth embodiment of a container according to the invention, in a closed position and with a release in a locked position.
Figure 25:
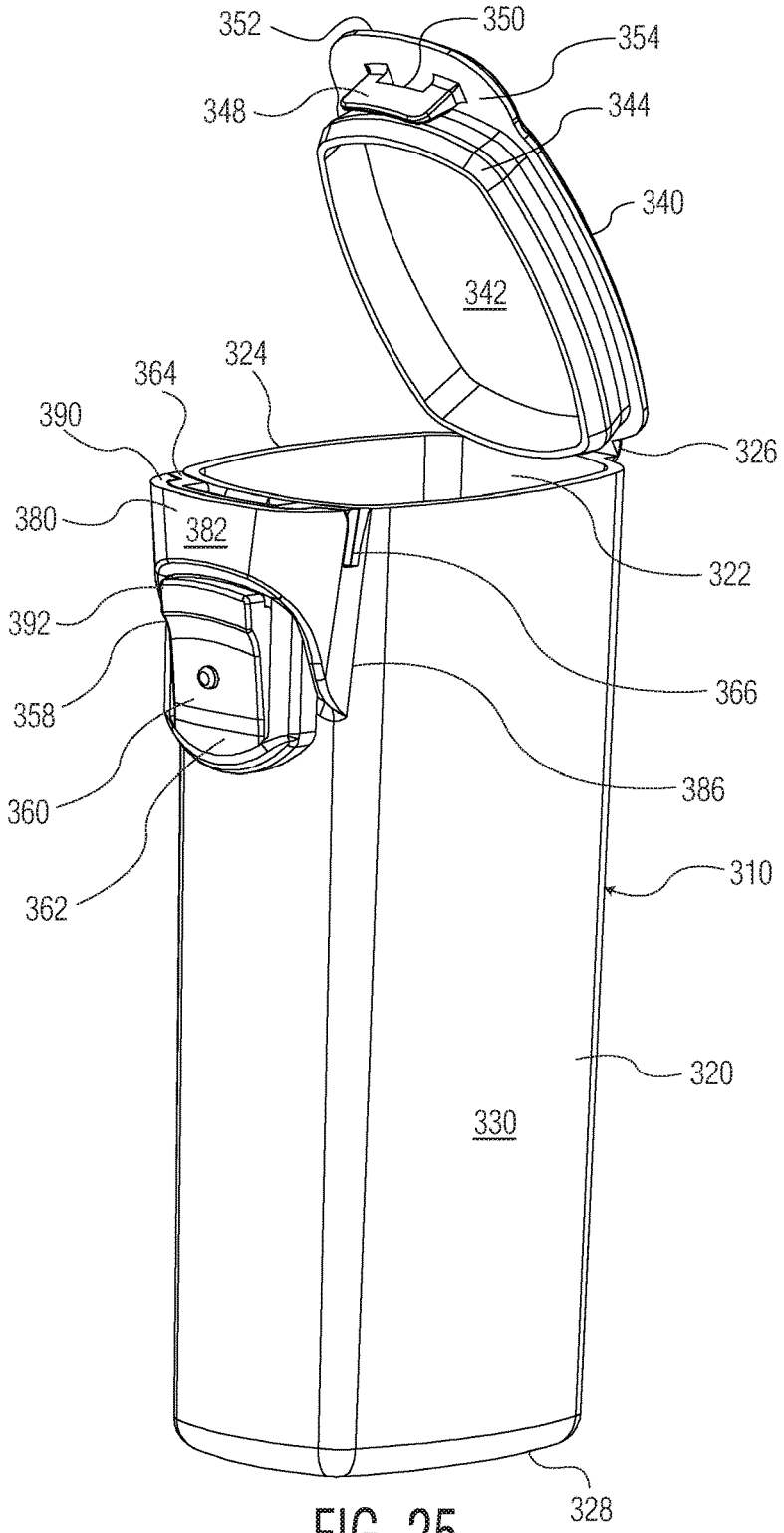
FIG. 25 is a front perspective view of the container of FIG. 24, in an opened position and with the release in the locked position.
Figure 26:
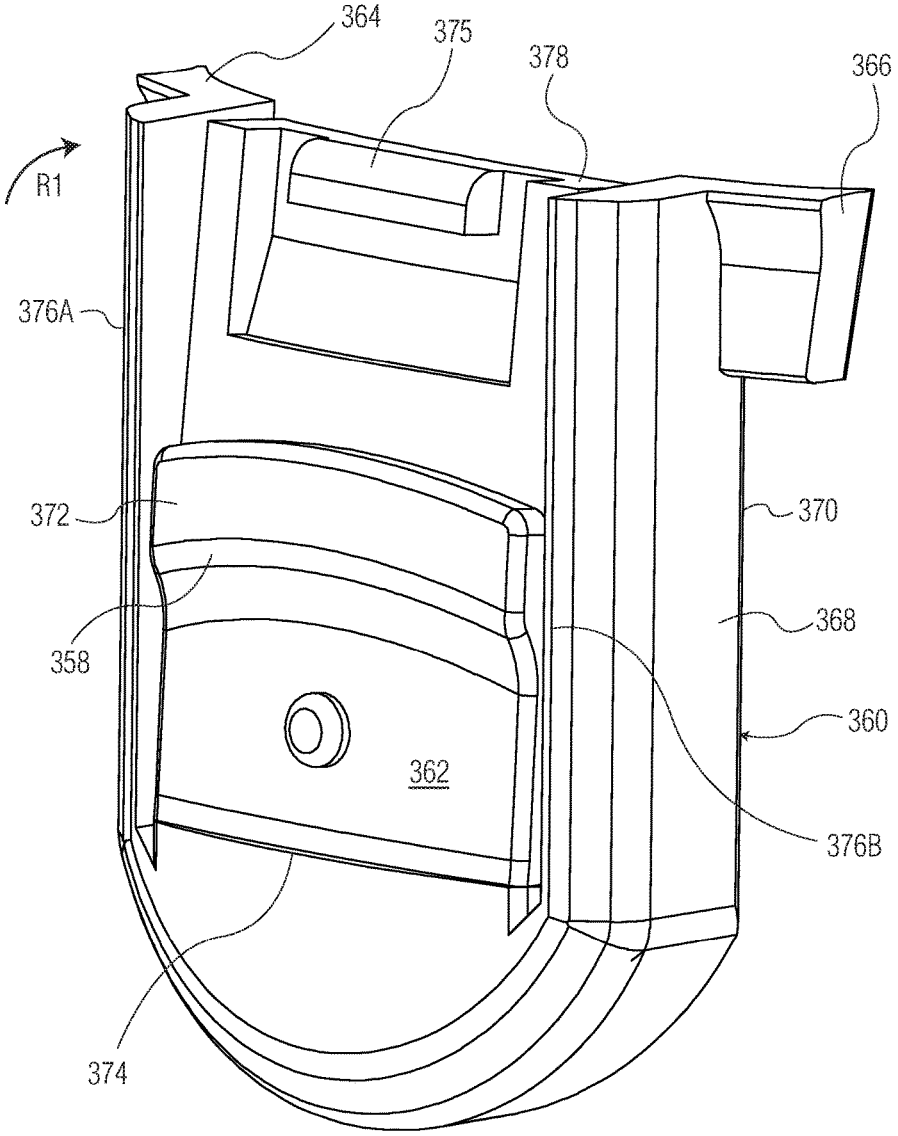
FIG. 26 is a front perspective view of the release of the container of FIG. 24.
Figure 27:
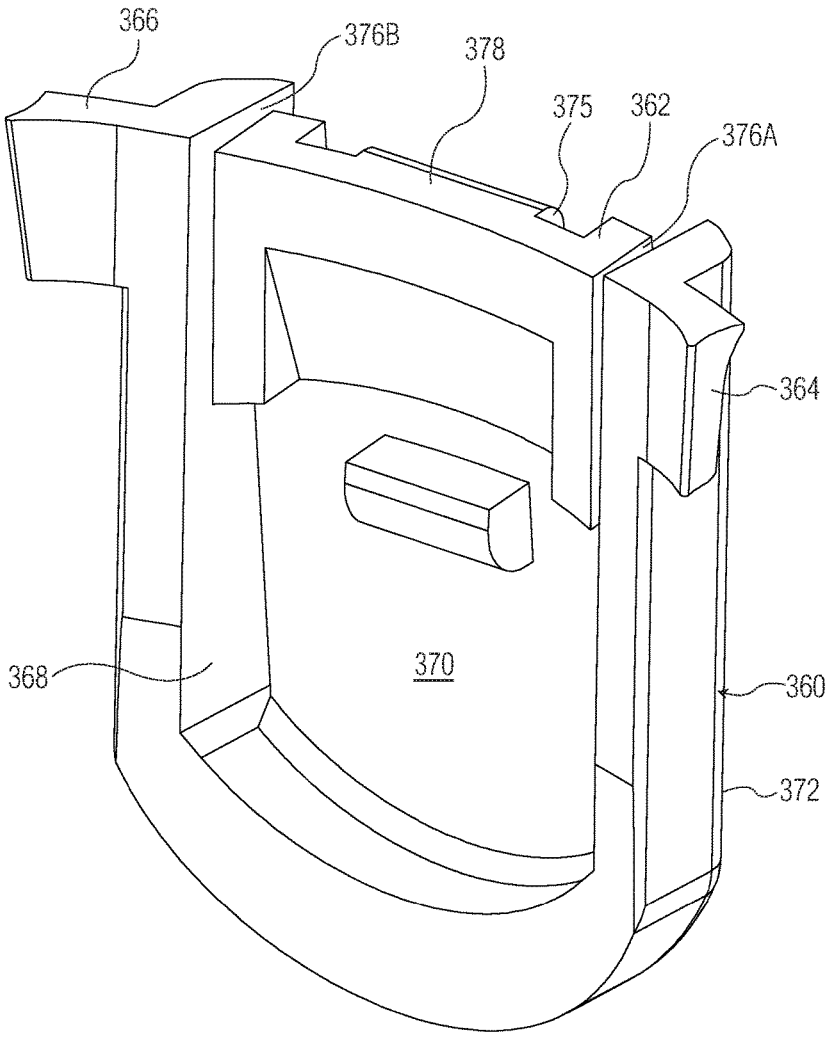
FIG. 27 is a rear perspective view of the release of the container of FIG. 24.
Figure 28:
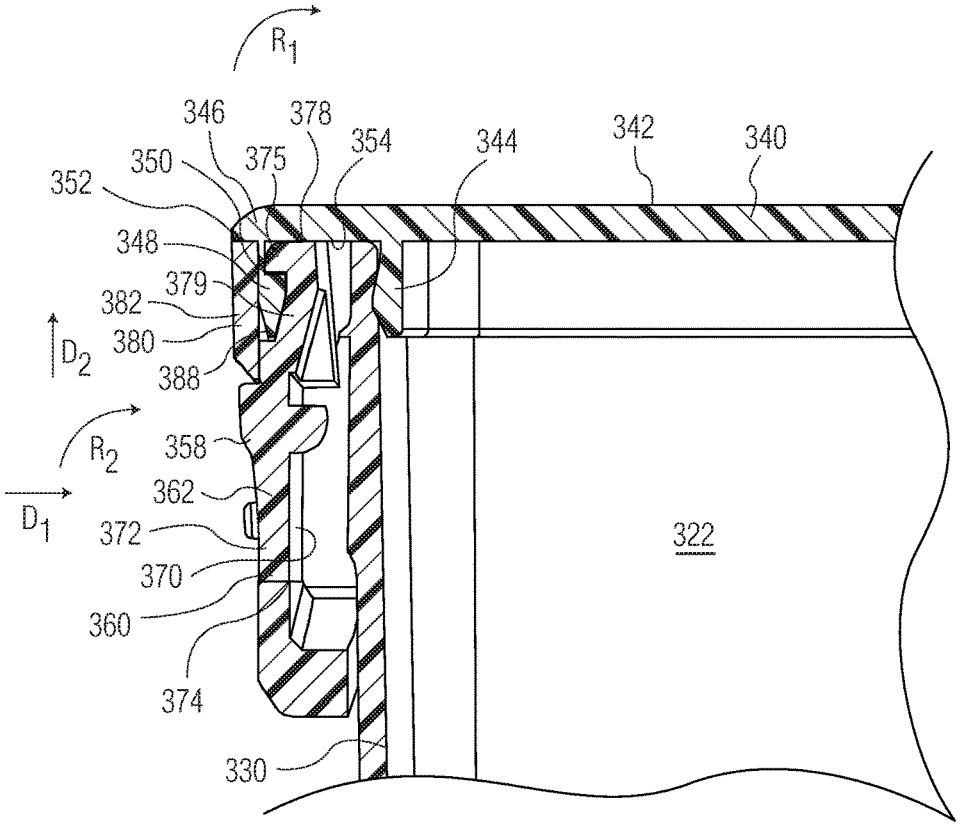
FIG. 28 is a partial cross section taken along line 28-28 of FIG. 24.
Figure 29:
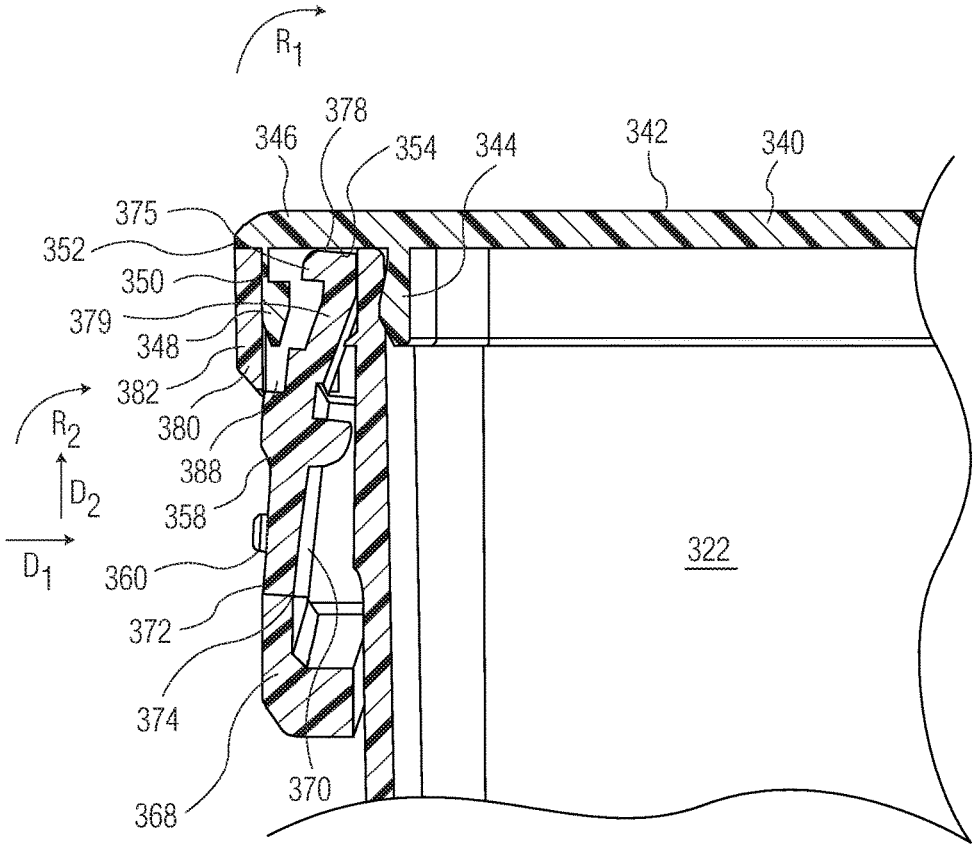
FIG. 29 is a partial cross section of the container as shown in FIG. 28, with the release in the unlocked position.

FIGS. 24-30 show a fourth embodiment of a container assembly 310 according to the invention. The container 310 may be, as in the example shown, a vial, for storing products such as pharmaceutical products, tobacco products, confections, or other food products. As shown, the container 310 includes a container body 320 having an interior 322 for housing a plurality of products 312 therein. The container body 320 defines an opening 324 leading to the interior 322. The container 310 further includes a lid 340 configured to cover the opening 324, the lid 340 being movable with respect to the container body 320 to move the container 310 between a closed position in which the opening 324 is covered by the lid 340, as shown in FIGS. 24, 27 and 28, and an opened position in which the opening 324 is exposed, as shown in FIG. 25. In the illustrated embodiment, the lid 340 is attached to the container body 320 by a hinge 326, such that the lid 340 is pivotably affixed to the body 320 to move the container 310 between the opened and closed positions. The container 310 further includes a release 360 and a release housing 380 affixed to a portion of the container body 320. The release 360 is movable within the release housing 380 between a locked position, as shown in FIGS. 24, 25 and 28, which retains the lid 340 in the closed position, and an unlocked position, as shown in FIG. 29, in which the release 360 disengages the lid 340 from the container body 320 to permit movement of the lid 340 from the closed position to the opened position.

The lid 340 is shown in detail in FIG. 25. As shown, the lid 340 includes a substantially planar base wall 342 configured to cover the container body opening 324 when the container 310 is in the closed position. An inner seal 344 extends downward from a bottom surface of the base wall 342. When the container 310 is in the closed position, the inner seal 344 extends into the container body side wall 330, as can be seen in FIGS. 28 and 29. As shown, the outer surface of the seal 344 contacts the inner surface of side wall 330, to form a seal between the side wall 330 and the seal 344.

Alternatively, the seal may be, for example, of the type disclosed in U.S. Pat. Nos. 7,537,137; 7,213,720 or 8,528,778.

A moisture tight seal may be formed between the container body 320 and the lid 340, for example, by way of the above-described engagement between the container body 320 and the seal 344.

A tab 346 extends from the front of the lid 340, at a location opposite the hinge 326 in the embodiment shown. The tab 346 is substantially planar, and substantially coplanar with the base wall 342, such that the tab 346 forms a forward extension of the base wall 342. The tab 346 is configured to extend over the release housing 380 when the container 310 is in the closed position, and to have an end 352 that is flush with or disposed slightly inward the respect to the outer surface of release housing 380 when the container is in the closed position, so that the bottom surface 354 of the tab 346 faces an upper side of the release housing 380, is generally inaccessible to a user when the container 310 is in the closed position, and cannot be used to open the container 310 except by using the release 360 in the manner described below. Likewise, the lid 340 preferably has an outer perimeter that is slightly less than, i.e., disposed radially inward with respect to that of the side wall 330, making the entire lower side of the lid 340 inaccessible to prevent opening of the container 310 by means other than use of the release 360 in the manner described below.

A guide 348 extends downward from a lower surface of the tab 346. As shown in FIGS. 28 and 29, the guide 348 engages release 360 when the container 310 is in the closed position, as described in detail below. A notch 350 is formed in an inner surface of the guide 348, facing radially inwardly with respect to the container 310 and at an upper portion of the guide 348 near where the guide 348 connects with the base wall 342. The notch 350 engages the release 360 to retain the container 310 in the closed position, as described in detail below.

The release housing 380 extends from the front of the container 310, out from the side wall 330 at an upper portion thereof. The housing 380 includes a bridge wall 382 that attaches to the container body side wall 330 at opposite ends 384, 386 thereof. As shown, for example in FIG. 24, a first end 384 of the bridge wall 382 joins the side wall 330 along an edge defined by the first end 384, the edge extending in a generally axial direction of the container body 320. The bridge wall 382 extends out from the side wall 330 in a curved path, and again joins with the side wall 330 along an edge defined by the second end 386, the edge extending in a generally axial direction of the container body. Accordingly, a housing space 388 is defined between the side wall 330, bridge wall 382, and first and second ends 384, 386 at which the side wall 330 and bridge wall 382 connect. The housing space 388 is configured to slidably house the release 360, as shown in FIGS. 24, 25 and 28-30. The housing space 388 may be configured to permit sliding of the release 360 in an axial direction of the container 310 within the housing space 380. An upper opening 390 is defined at the top of the housing space 388, and a lower opening 392 is defined at the bottom of the housing space 388. The upper opening 390 is configured to permit passage of the uppermost portion of the release 360 therethrough, and the lower opening 392 is configured to permit passage of the lowermost portion of the release 360 therethrough. The upper opening 390 is defined substantially axially level with, or close to the upper edge of container body side wall 330, as shown in FIGS. 25 and 28-30, and is positioned to be covered by tab 346 when the container 310 is in the closed position. The lower opening 392 may extend in an arced path, towards the container lid 330, as it transverses between ends 384, 386, so as to expose the release button 362, as shown in FIGS. 24 and 25, and described in further detail below.

As shown, for example, in FIGS. 24 and 25, notches 394, 396 are cut into the bridge wall, at the corners thereof formed between upper opening 390 and each of the ends 384, 386. Notches are rectangular in the embodiment shown, and are configured to receive arms 364, 366 of the release button 360.

FIGS. 26 and 27 show the release 360 in detail. As shown, the release 360 includes a body 368 having a generally curved configuration to match the outer curvature of the container body side wall 330 and the inner curvature of the bridge wall 382. The release body 368 is configured to fit between the side wall 330 and the bridge wall 382, within the housing space 388 defined therebetween. The release 360 includes an inner side 370 that faces the container body 320 when disposed within the housing space 388, and an outer side 372 that faces away from the container body and in some areas towards the bridge wall 382 when disposed within the housing space 388.

As best shown in FIG. 26, a button 362 is formed on the outer side 372 of release body 368. The button 362 is attached to release body 368 along an axis 374 that extends along the bottom edge of the button 362. Slots 376A, 376B extend in an upward or axial direction of the container, along opposite sides of the button, up to the top edge 378 of the release body 368, separating the button 362 from the side portions of the release body 368. This arrangement permits the button to pivot in direction R2 with respect to the release body 368, to move the release 360 between a locked position, as shown in FIGS. 24, 25 and 28, and an unlocked position, as shown in FIG. 29. The button 362 may bias the release 360 towards the locked position, for example, by forming the button 362 and release body 368 as an integral unit, of material sufficiently stiff so as to resist pivoting of the button in direction R2.

A latch 375 is formed at a top portion of the button. As shown, for example, in FIGS. 26 and 28-30, the latch 375 is formed as a hook that protrudes outward from the outer side of the release 360. The latch 375 fits within the notch 350 and is housed therein when the container is in the closed position and the release is in the locked position, to retain the lid 340 over the opening 324 and retain the container in the closed position. While the latch 375 is specifically described and shown in the embodiment of FIGS. 24-30, it should be understood that it could be included in any of the embodiments described herein.

FIGS. 24 and 28 show the release 360 in the locked position. In this position, the button 362 protrudes from beneath the bridge wall 382. An upper portion 379 of the button 362, is held between the guide 348 and the side wall 330, with the latch 375 of the release housed within the notch 350 of the guide 348. The arms 364, 366 are located within notches 394, 396, and the top edge 378 of the release 360 is located generally flush with the top edge 334 of container body side wall 330. The top edge 378 of release 360 abuts the bottom surface 354 of lid tab 346.

Figure 30:
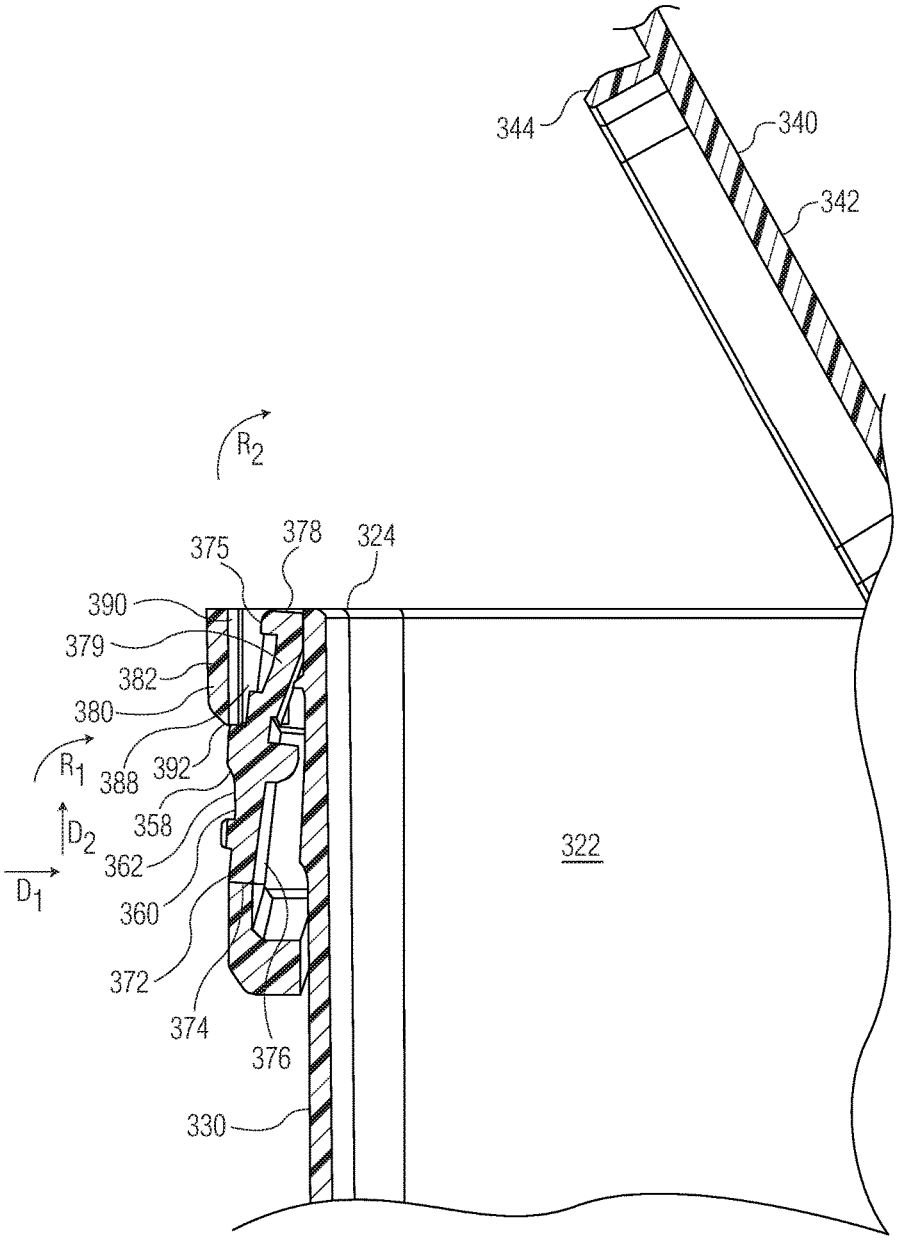
FIG. 30 is a partial cross section of the container as shown in FIG. 28, in an opened position and with the release in the unlocked position.

In order to move the container 310 from the closed position, shown in FIGS. 24, 28 and 29, to the opened position, shown in FIG. 25, the release 360 must be moved from the locked position, as shown in FIGS. 24, 25 and 28, to the unlocked position, as shown in FIG. 29. This is achieved by depressing the button 362 in direction D1, which is an inward, radial direction of the container 310, as shown in FIG. 28. This causes inward pivoting of the button 362 in direction R2. Once the button 362 has been sufficiently displaced in direction R2 so as to clear the bridge wall 382 of the release housing 380, and to release latch 375 from notch 350, the release 360 can be slid upwards, in an axial direction of the container 310, direction D2, to the unlocked position. The top of the upper portion 379 of the release 360, which is in contact with the bottom surface 354 of the lid tab 346 when the container 310 is closed, pushes up on the tab 346, which, due to its end 352 being flush with or inwardly disposed with respect to bridge wall 382, cannot otherwise be accessed by a user of the container 310. The upward driving of the tab 346 by the release 360 causes pivoting of the lid 340 in direction R2, resulting in opening of the container 310, as shown in FIG. 30.

The button 362 may include finger grip 358, for example, an indentation or, as shown in the illustrated example, a ridge placed for engagement by the finger of a user, to facilitate movement of the release 380 from the locked position to the unlocked position. Alternatively, the finger grip 358 may include a textured surface (e.g., in the style of a pistol grip).

Once pressure on the button 362 in direction D1 is released, the button 362, due to its bias toward the locked position, as described above begins to return the release 360 to the locked position, by pivoting in the reverse direction of R2. This, in turn, urges the button 362 downward, in the reverse direction of D2, so that the button 362 can clear the bridge wall 382 and pivot fully outward to its biased position. This returning action of the button 362 can occur when a user removes pressure from the button 362, and when the container 310 is in an opened position, as shown in FIG. 30, or when the container 310 is in a closed position, as shown in FIG. 24.

Figure 31:
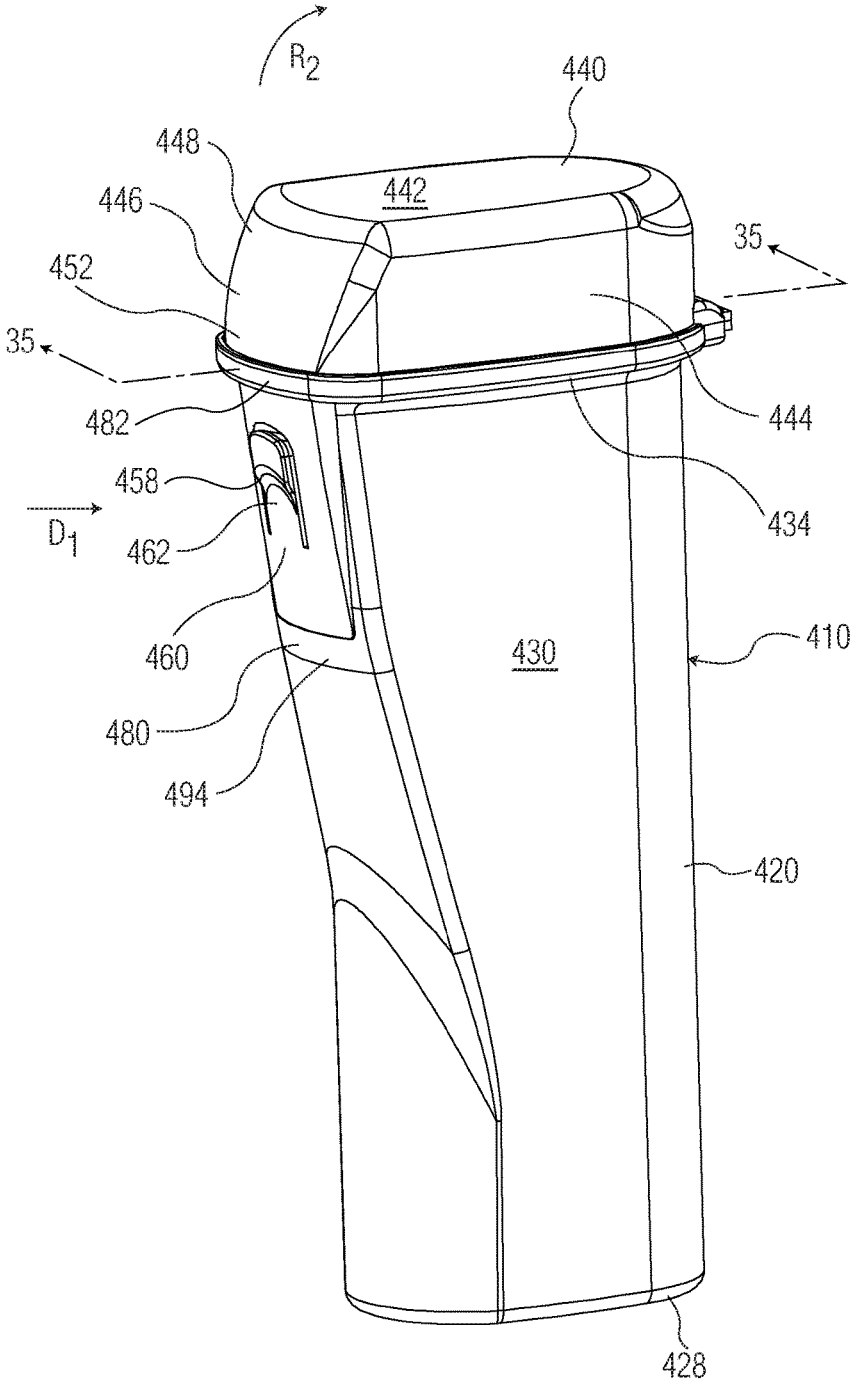
FIG. 31 is a front perspective view of a fifth embodiment of a container according to the invention, in a closed position and with a release in a locked position.
Figure 32:
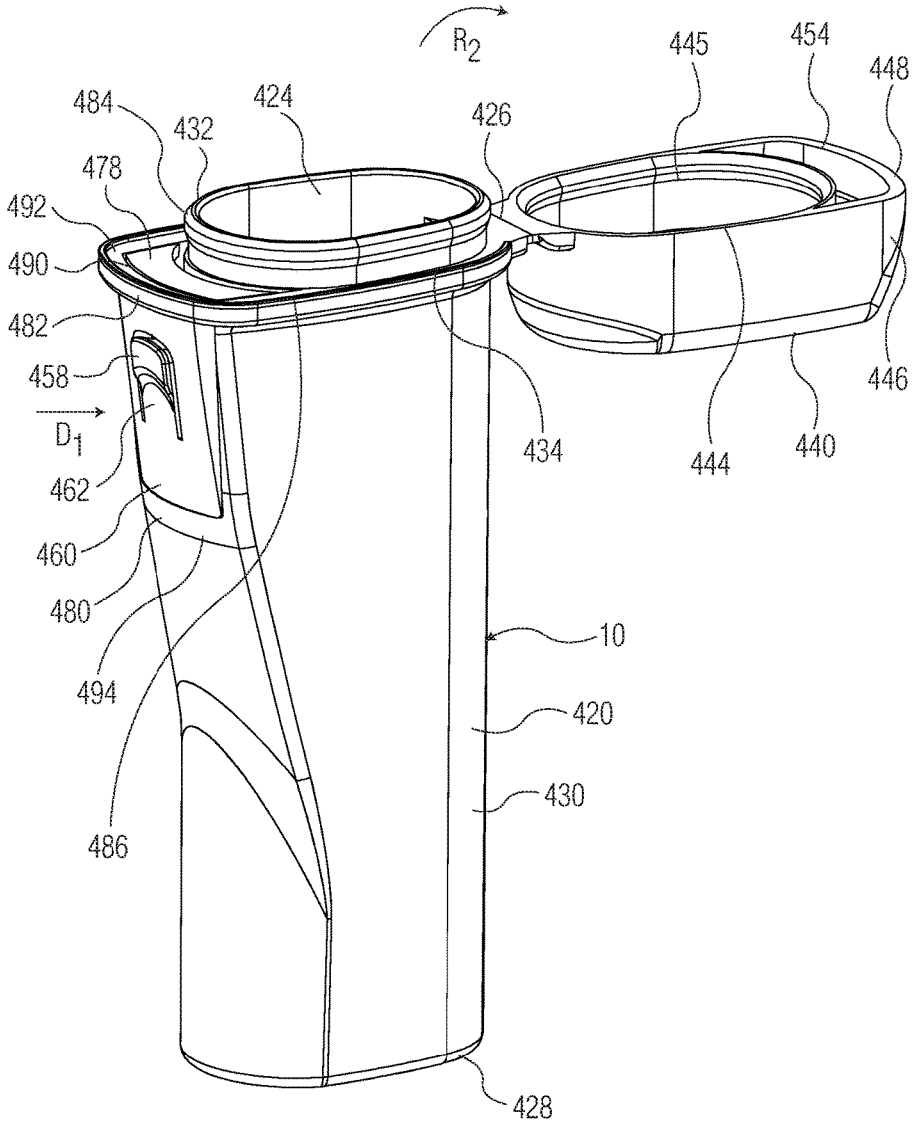
FIG. 32 is a front perspective view of the container of FIG. 31, in an opened position and with the release in the locked position.
Figure 33:
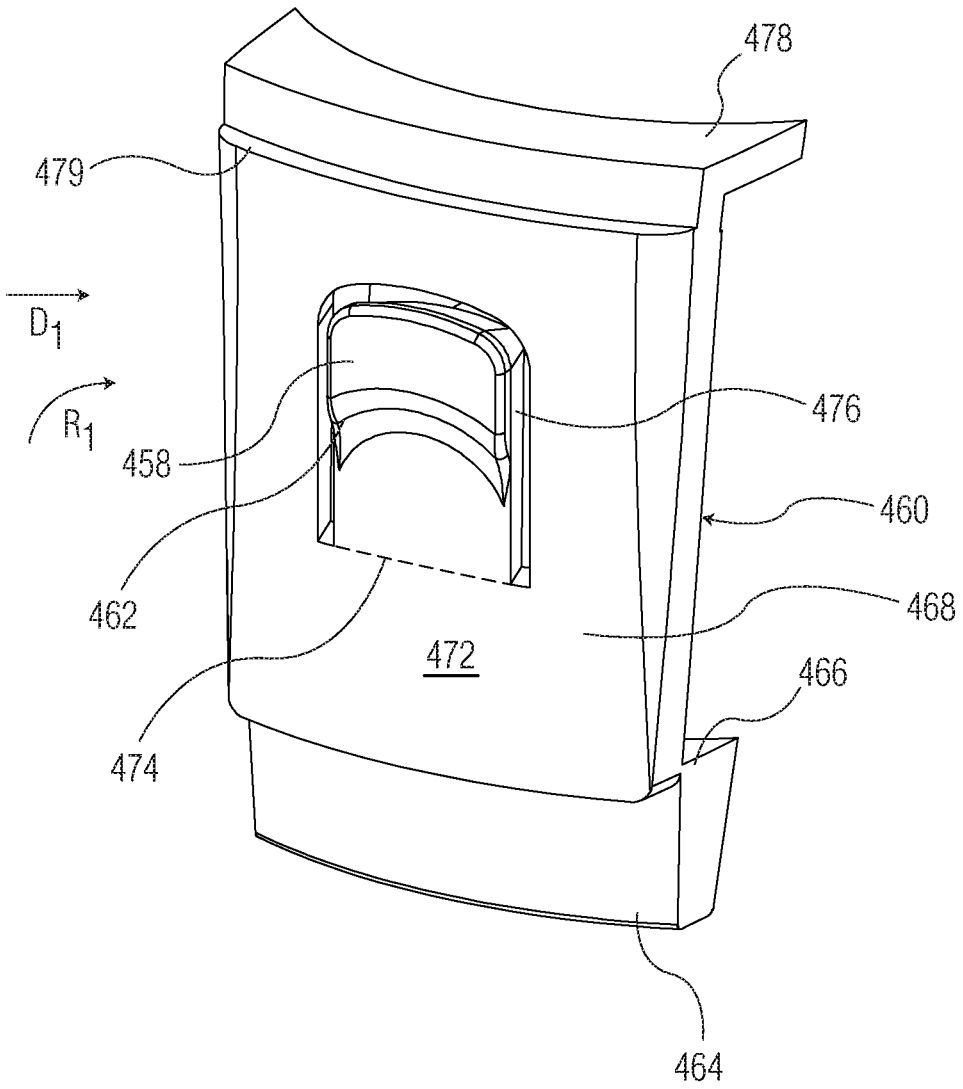
FIG. 33 is a front perspective view of the release of the container of FIG. 31.
Figure 34:
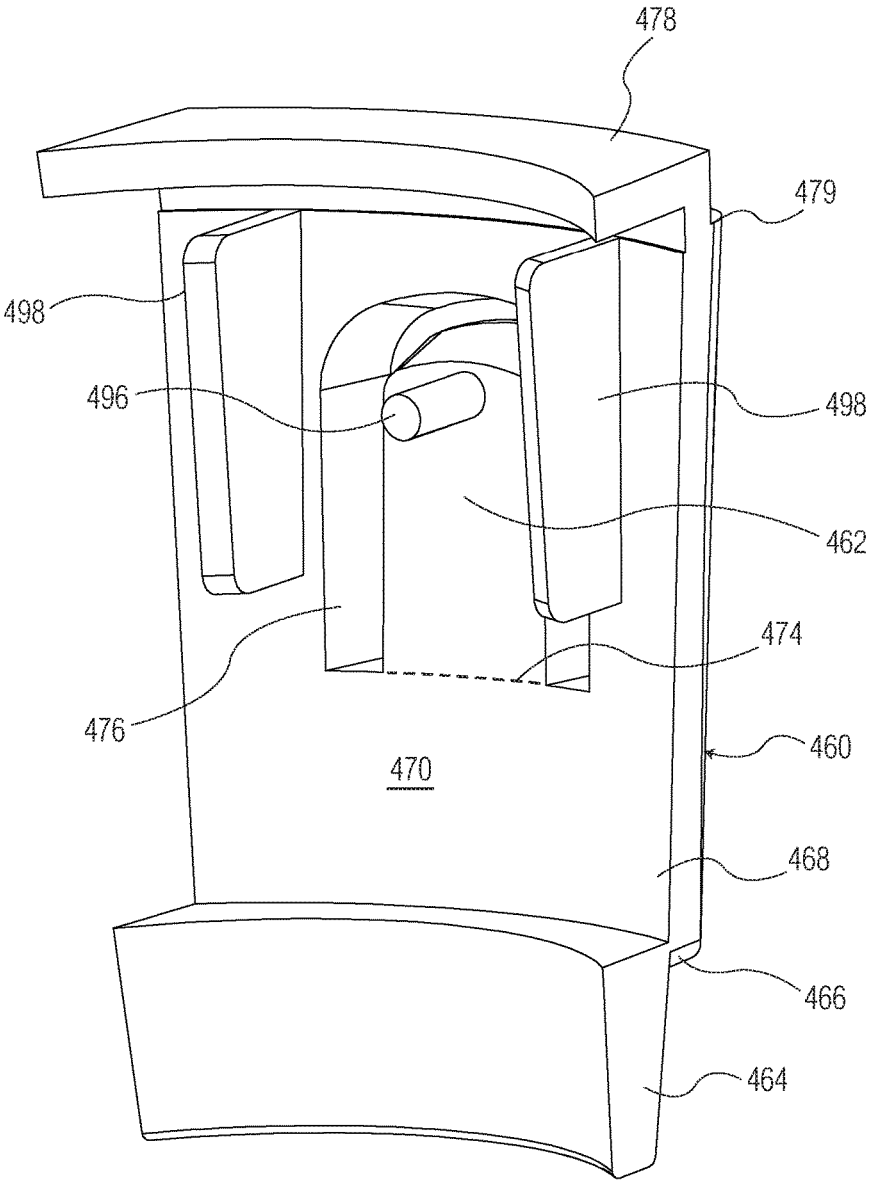
FIG. 34 is a rear perspective view of the release of the container of FIG. 31.
Figure 35:
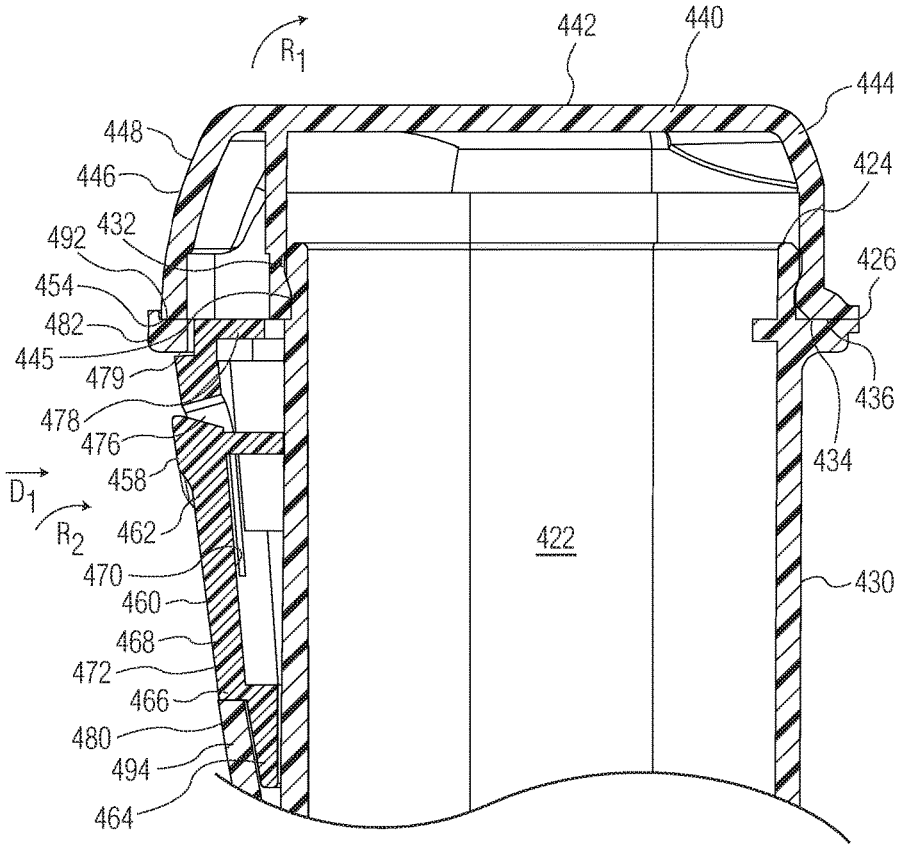
FIG. 35 is a partial cross section taken along line 35-35 of FIG. 31.
Figure 36:
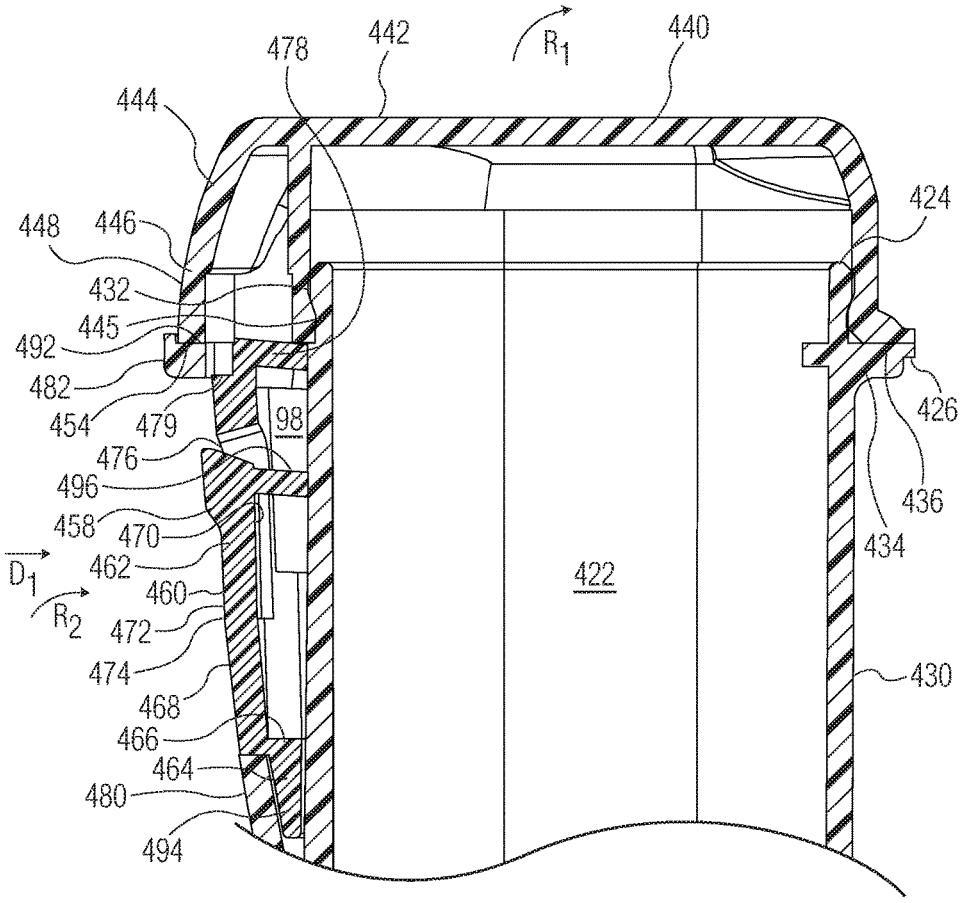
FIG. 36 is a partial cross section of the contains as shown in FIG. 35, in the opened position and with the release in the unlocked position.

FIGS. 31-37 show a fifth embodiment of a container assembly 410 according to the invention. The container 410 may be, as in the example shown, a vial, for storing products such as pharmaceutical products, tobacco products, confections, or other food products. As shown, the container 410 includes a container body 420 having an interior 422 for housing a plurality of products 412 therein. The container body 420 defines an opening 424 leading to the interior 422. The container 410 further includes a lid 440 configured to cover the opening 424, the lid 440 being movable with respect to the container body 420 to move the container 410 between a closed position in which the opening 424 is covered by the lid 440, as shown in FIGS. 31, 35 and 36, and an opened position in which the opening 424 is exposed, as shown in FIG. 32. In the illustrated embodiment, the lid 440 is attached to the container body 420 by a hinge 426, such that the lid 440 is pivotably affixed to the body 420 to move the container 410 between the opened and closed positions. The container 410 further includes a release 460 and a release housing 480 affixed to a portion of the container body 420. The release 460 is movable within the release housing 480 between a locked position, as shown in FIGS. 31, 32 and 35, which retains the lid 440 in the closed position, and an unlocked position, as shown in FIG. 36, in which the release 460 disengages the lid 440 from the container body 420 to permit movement of the lid 440 from the closed position to the opened position.

The container body 420 includes a bottom wall 428 and substantially tubular side wall 430 extending upward from the bottom wall 428, about the outer edges thereof. The bottom wall 428 and side wall 430 define the interior 422. A rim 434 extends around the side wall 430 at a location slightly below the opening 424 and above housing 480. The rim 434 defines a seating surface 436 to support the lid 440 when the container assembly 410 is in the closed position. As shown in FIGS. 31 and 32, the rim 434 further forms an interruption between the release 460 or outer surface of the side wall 430 and the lid 440, which may assist to prevent accidental opening of the container 410, which could occur, for example by a user's finger inadvertently sliding upward along the container body 420 towards the lid 440. In such an instance, the rim 434 would interrupt the movement of the user's finger before reaching the lid 440 and accidentally disengaging the lid 440 from the container body 420. An outer sealing ridge 432 may be formed at an upper edge of the side wall 430 on the outer surface thereof, above the rim 432 to seal and engage the lid 440 with the container body 420, to retain the container 410 in the closed position, as described in detail below.

The lid 440 is shown in detail in FIG. 32. As shown, the lid 440 includes a substantially planar base wall 442 configured to cover the container body opening 424 when the container 410 is in the closed position. A skirt 444 extends downward from a bottom surface of the base wall 442. An inner sealing ridge 445 projects from an inner surface of the skirt 444. When the container 410 is in the closed position, an upper portion of the container body side wall, including the outer sealing ridge 432, extends into the inner surface of the skirt 444, as can be seen in FIG. 35. As shown, the inner surface of the skirt 444 contacts the outer surface of side wall 430, with the outer sealing ridge 432 in contact with and positioned just below the inner sealing ridge 445, to form a seal between the side wall 430 and the skirt 444.

Alternatively, the seal may be, for example, of the type disclosed in U.S. Pat. Nos. 7,537,137; 7,213,720 or 8,528,778.

A moisture tight seal may be formed between the container body 420 and the lid 440, for example, by way of the above-described engagement between the container body 420 and the skirt 444.

A tab 446 extends from the front of the lid 440, at a location opposite the hinge 426 in the embodiment shown. The tab 446 is substantially planar, and substantially coplanar with the base wall 442, such that the tab 446 forms a forward extension of the base wall 442. The tab 446 further includes a guide wall 448 extending downward from the base wall 442. The guide wall 448 extends downward about the perimeter of the tab 446 that forms the front and sides thereof, and joins with the skirt 444 at the rear of the tab 446. The tab 446 is configured to extend over the release housing 480 when the container 410 is in the closed position, and to have an end 452 that is substantially flush with or located slightly inward with respect to the outer surface of release housing 480 when the container is in the closed position, so that the bottom surface 454 of the guide wall 448 faces an upper side of the release housing 480 and is generally inaccessible to a user when the container 410 is in the closed position. In this respect, the tab 446 cannot be used to open the container 410 except by using the release 460 in the manner described below. Likewise, the lid 440 preferably has an outer perimeter that is slightly less than, i.e., disposed radially inward with respect to that of the side wall 430, making the entire lower side of the lid 440 inaccessible to prevent opening of the container 410 by means other than use of the release 460 in the manner described below.

The release housing 480 extends from the front of the container 410, out from the side wall 430 at an upper portion thereof. As shown, for example, in FIG. 37, the housing 480 includes a bridge wall 482 that attaches to the container body side wall 430 at opposite ends 484, 486 thereof and joins with the rim 434. Like the rim 434, the bridge wall 482 forms a seating surface 492, which is formed as an extension of the seating surface 436 of the rim 432. As shown, for example in FIG. 37, first and second ends 484, 486 of the bridge wall 482 join the side wall 430 at front portions of opposite sides thereof to meet with the rim 434. The bridge wall 482 extends out from the side wall 430 in a curved path between the first and second ends 484, 486 thereof. Accordingly, a housing space 488 is defined between the side wall 430, bridge wall 482, and first and second ends 484, 486 at which the side wall 430 and bridge wall 482 connect. The housing space 488 is configured to slidably house the release 460, as shown in FIGS. 31, 32, 35 and 36. A pocket 494 is formed below the bridge wall 482. The pocket 494 forms a lower portion of the housing space 488 and is configured to slidably house a lower portion of the release 460. An outer surface of the pocket 494 may be continuous with an outer surface of the container side wall 430 to which it is attached.

Figure 37:
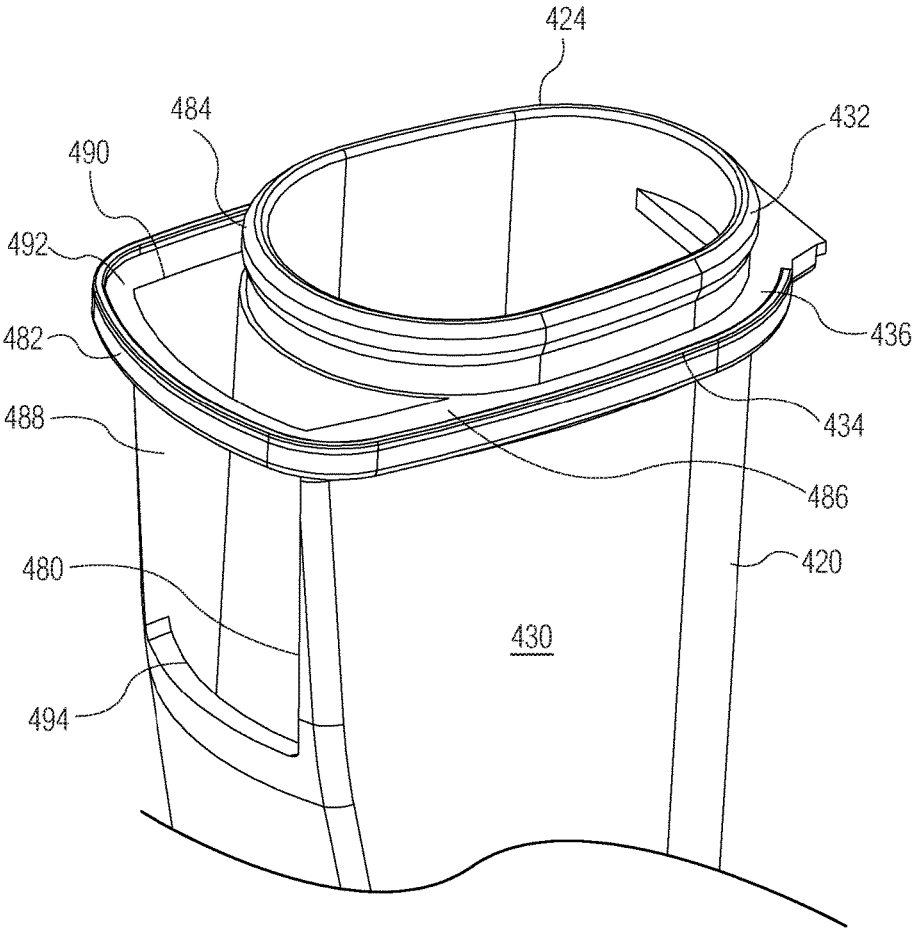
FIG. 37 is an enlarged front perspective view of the container of FIG. 31, with the release and lid removed.
Figure 38:
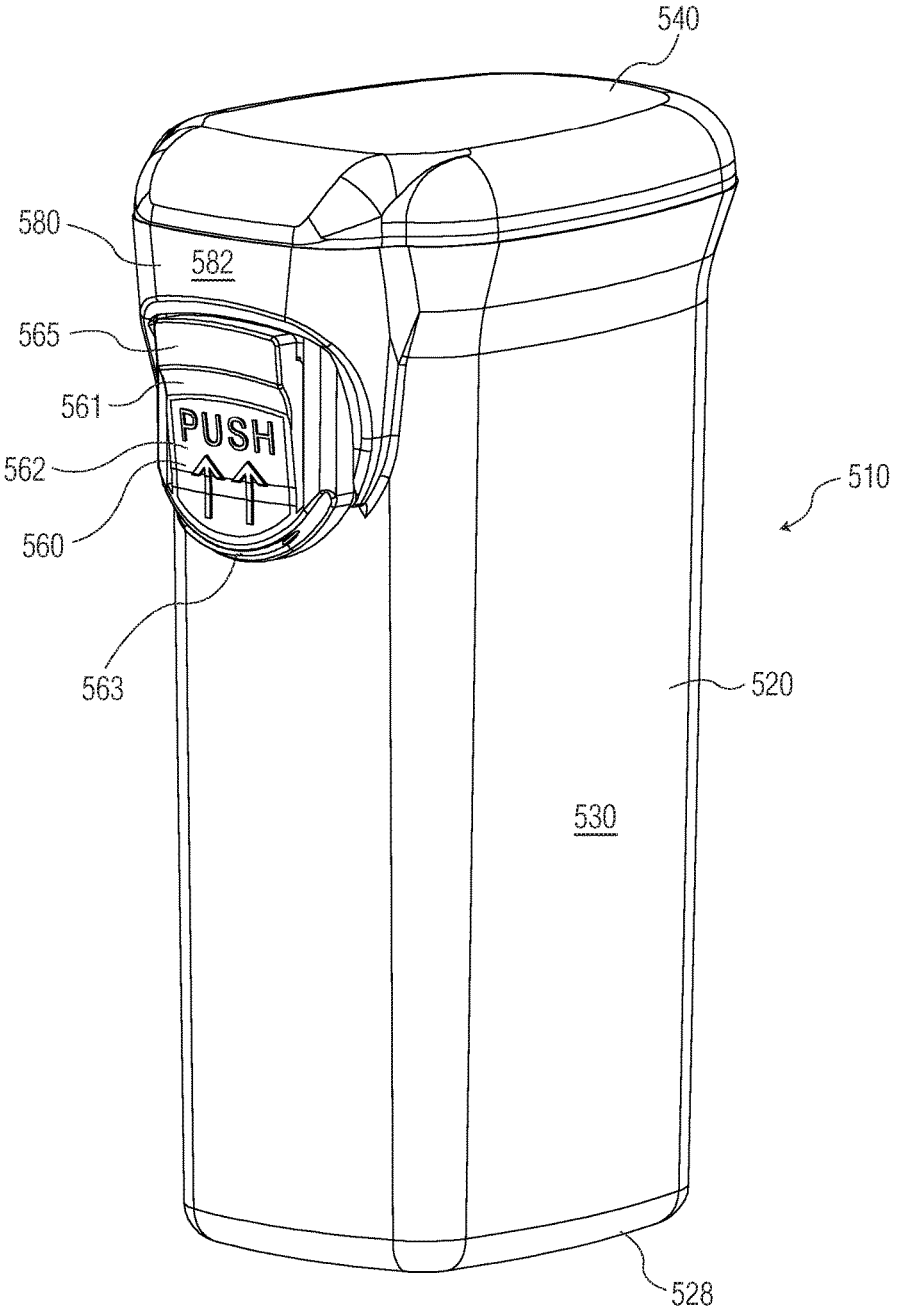
FIG. 38 is a front perspective view of a sixth embodiment of a container according to the invention, in a closed position and with a release in a locked position.

The housing space 488 is configured to permit sliding of the release 460 in an axial direction of the container 410 within the housing space 488. An upper opening 490 is defined at the top of the housing space 488. The upper opening 490 is configured to permit passage of the uppermost portion of the release 460 therethrough. The upper opening 490 is defined substantially axially level with, or close to axially level with the seating surface 436 of the rim 434, as shown in FIG. 37, and is positioned to be covered by tab 446 when the container 410 is in the closed position.

FIGS. 33 and 34 show the release 460 in detail. As shown, the release 460 includes a body 468 having a generally curved configuration to match the outer curvature of the container body side wall 430 and the inner curvature of the bridge wall 482. The release body 468 is configured to fit between the side wall 430 and the bridge wall 482, within the housing space 488 defined therebetween. The release 460 includes an inner side 470 that faces the container body 420 when disposed within the housing space 488, and an outer side 472 that faces away from the container body 420 and in some areas towards the bridge wall 482 when disposed within the housing space 488.

As best shown in FIG. 33, a button 462 is formed on the outer side 472 of release body 468. The button 462 is attached to release body 468 along an axis 474 that extends along the bottom edge of the button 462. A slot 476 having an inverted "u" shape traverses the side and upper edges of the button 462, separating the button 462 from the surrounding portions of the release body 468. This arrangement permits the button 462 to pivot in direction R2 with respect to the release body 468. When the button 462 has been pivoted in direction R2 with respect to the body 468 to the maximum extent that its connection thereto will permit, the button 462 can continue to be depressed in direction R2, and will then draw the body 468 in direction R2 with it, to permit moving of the button 462 and body 468 between a locked position, as shown in FIGS. 31, 32 and 35, and an unlocked position, as shown in FIG. 36. The button 462 and body 468 may bias the release 460 towards the locked position, for example, by forming the button 462 and release body 468 as an integral unit, of material sufficiently stiff so as to resist pivoting of the button 462 and body 468 in direction R2.

A bottom wall 464 of the release 460 is inwardly offset from the body 468 by a connecting wall 466 that extends generally perpendicular to the body 468 and bottom wall 464 and joins the two. A top wall 478 extends inward with respect to the container assembly 410 from a top edge of the body 468, also generally perpendicular to body 468 and bottom wall 464. A shoulder 479 is defined within the body 468 on the front side thereof, slightly below the top wall 478 and above the button 462. Referring to FIG. 34, an arm 496 extends from the back surface of the button 462, and two ribs 498 extend from the back surface of the body 468, on opposite sides of the button 462.

FIGS. 31, 32 and 35 show the release 460 in the locked position, in which the release 460 is housed within the housing space 488 of the release housing 480. In this position, the body 468 and button 462 protrude from beneath the bridge wall 482 and above pocket 494. The bottom wall 464 is housed within the pocket 494. Top wall 478 fits between bridge wall 482 and the side wall 430 of the container body 420, with bridge wall 482 sitting on the shoulder 479. Arm 496 and ribs 498 each extend back towards side wall 430, possibly coming into contact with the side wall 430.

In order to move the container 410 from the closed position, shown in FIGS. 31, 35 and 36 to the opened position, shown in FIG. 32 the release 460 must be moved from the locked position, as shown in FIGS. 31, 32 and 35, to the unlocked position, as shown in FIG. 36. This is achieved by depressing the button 462 in direction D1, which is an inward, radial direction of the container 410. The button 462 will initially pivot in direction R2 about axis 474. When the button 482 has pivoted to the maximum extent with respect to body 468, the body 468 and top wall 478 will begin to pivot in direction R2 as well. When the release is positioned further inward than bridge wall 482 with respect to the container assembly 410, the body 468 can be moved in an upward direction, past bridge wall 482, without interference therefrom. During pivoting of the release 460 in direction R2 arm 496 and ribs 498 push inward, in direction D1, on the side wall 430 of the container body. This, in turn, causes inward movement of the rim 434 and associated outer sealing ridge 432, away from skirt 444 and associated inner sealing ridge 445, to facilitate disengagement of the lid 440 from the container body.

Once the release 460 has been moved as described above and shown in FIG. 36, it can then be fully moved into the unlocked position by sliding upwards within the housing space 488. During this process, the top wall 478 moves upwards and drives the skirt 444, located directly above it, in an upwards direction, causing the entire lid 440 to pivot in direction R1 with respect to the container body 420, resulting in opening of the assembly. The above-described disengagement of the outer sealing ridge 432 and inner sealing ridge 445 allows for easy release of the lid 440 in advance of this process.

The button 462 may include finger grip 458, for example, an indentation or, as shown in the illustrated example, a ridge placed for engagement by the finger of a user, to facilitate movement of the release 460 from the locked position to the unlocked position. Alternatively, the finger grip 458 may include a textured surface (e.g., in the style of a pistol grip).

Once pressure on the button 462 in direction D1 is released, the button 462 and body 468, due to being biased toward the locked position, as described above, begin to return to the locked position, by pivoting in the reverse direction of R2. This, in turn, urges the body 468 downward, so that it can clear the bridge wall 482 and pivot fully outward to its biased position. This returning action of the body 468 can occur when a user removes pressure from the button 462, and when the container 410 is in an opened position, as shown FIG. 32 or when the container 410 is in a closed position, as shown in FIG. 31.

Any embodiment of the container 10, 110, 210, 310, 410 described herein can be provided with a desiccant, which may be in the form of a desiccant plastic including a base polymer, channeling agent, and desiccant. Such materials are described in, for example U.S. Pat. Nos. 5,911,937; 6,214,255; 6,130,263; 6,080,350; 6,174,952; 6,124,006; and 6,221,446, all to Hekal, and which are incorporated herein by reference. The descant plastic could be provided as a liner, puck, or other type of insert.

FIGS. 38-43 show a sixth embodiment of a container assembly 510 according to the invention. The container 510 may be, as in the example shown, a vial, for storing products such as pharmaceutical products, tobacco products, confections, or other food products. In several respects, the container 510 is substantially similar in structure and function to the containers 10, 110, 210, 310, 410 described above. The container 510 may incorporate some or all features of containers 10, 110, 210, 310, 410 described above. For the sake of brevity, detailed description of the structure and function of common features as between the container 510 and one or more of the other containers 10, 110, 210, 310, 410 are not repeated here. Such common features may include, but are not necessarily limited to, a container body 520, a bottom wall 528, a side wall 530, a lid 540, a hinge 526, a release housing 580, a bridge 582, a housing space 588, a guide 548, a slit 550, a release 560 and a button 562. Aspects of these common features may be substantially similar to, or (in some cases) differ structurally and/or functionally from their counterparts in other container embodiments 10, 110, 210, 310, 410. Some important differences are noted as follows.

The release housing 580 includes arms 586 which extend downward along the substantial length of the release 560. The arms 586 help to stabilize the release 560 and prevent the release 560 from moving from side to side when a user depresses the button 562 and moves the button 562 axially upwards. Additional stability of the release 560 is provided by rails 587 that run vertically along the inside of the arms 586. Guides 592 on either side of the rear of the button 562 slidably contact the rails 587. This feature further stabilizes the release 560 when in use, for example, by preventing the button 562 from rocking radially with respect to the container body 530 and enabling the button 562 to move in a purely vertical direction when a user moves the button 562 upwards.

The release 560 includes a catch 561 that helps to prevent a user's finger or thumb from inadvertently sliding upwards from the button 562 when attempting to move the button 562 vertically. Preferably, the catch 561 includes a sharper angle and more abrupt change leading to the top 565 of the button 562 than shown in the figures. This feature would assist in preventing a user's thumb, finger or nail from inadvertently traveling further upwards on the button 562. Further, the button 562 preferably includes an extended raised rib 563 to assist in maintaining a user's thumb/finger position.

Figure 39:
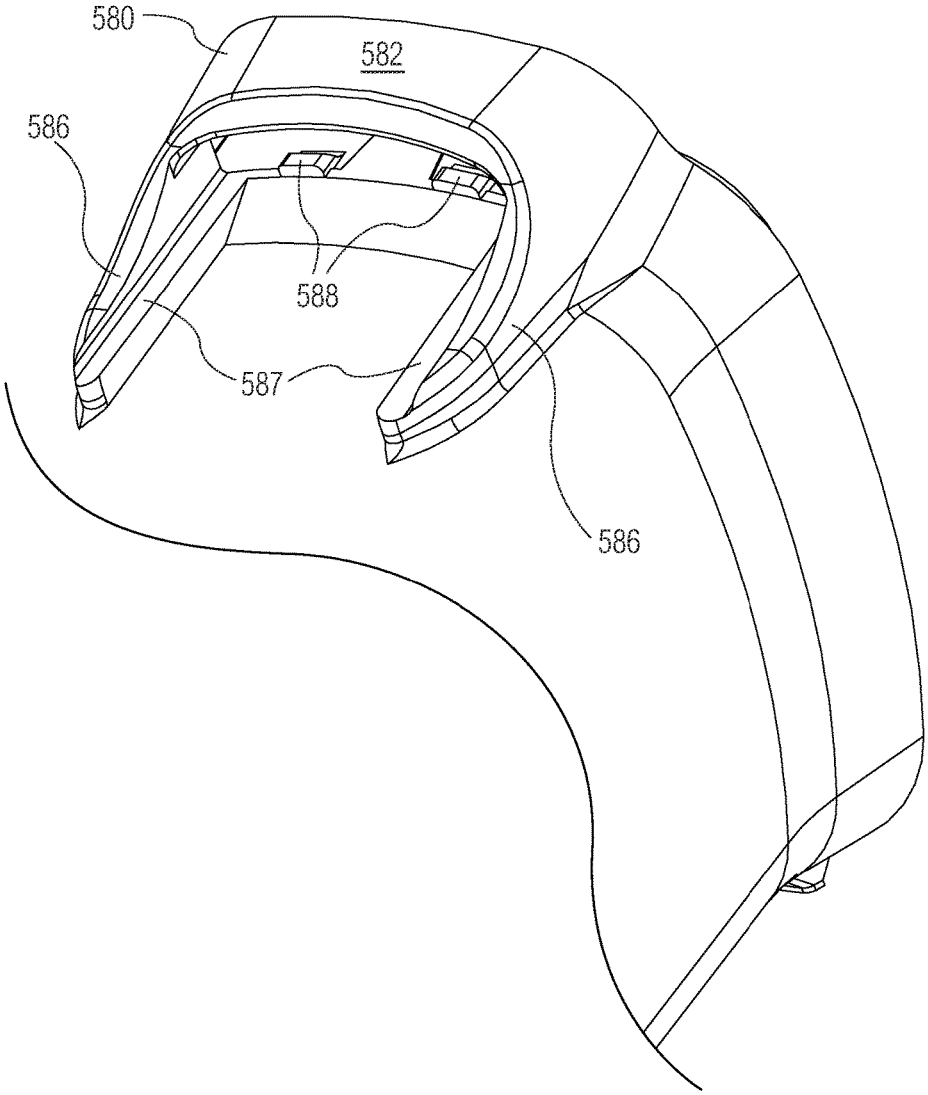
FIG. 39 is an enlarged partial front perspective view of the container of FIG. 38, with the release and lid removed.
Figure 40:
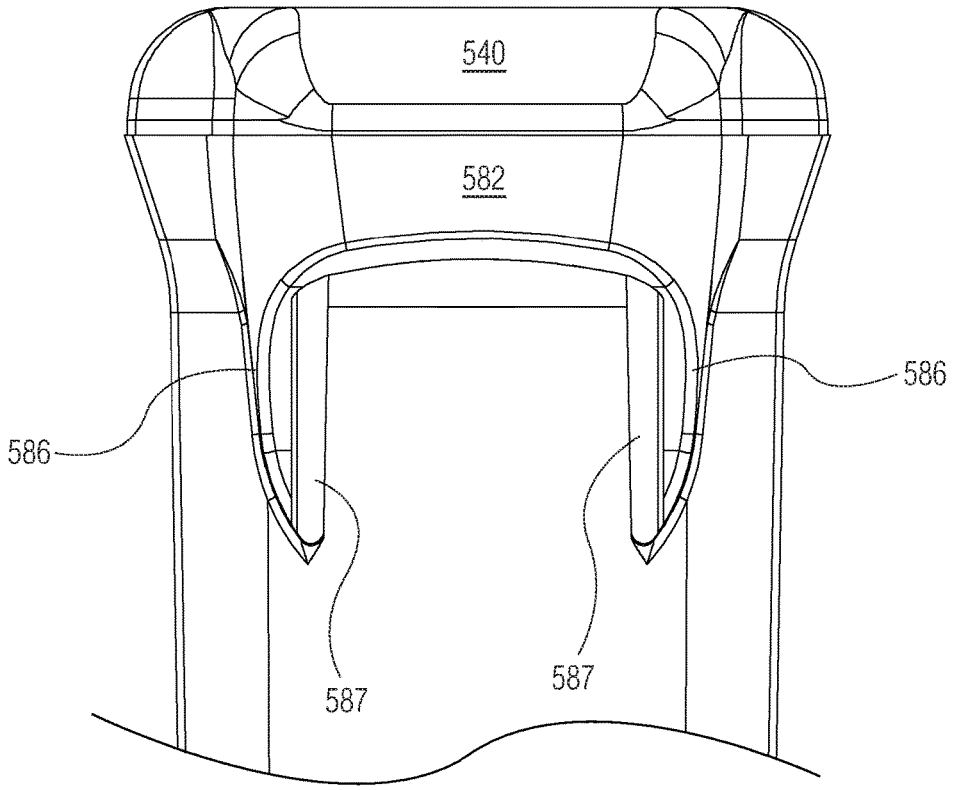
FIG. 40 is an enlarged partial front plan view of the container of FIG. 38, with the release removed.
Figure 41:
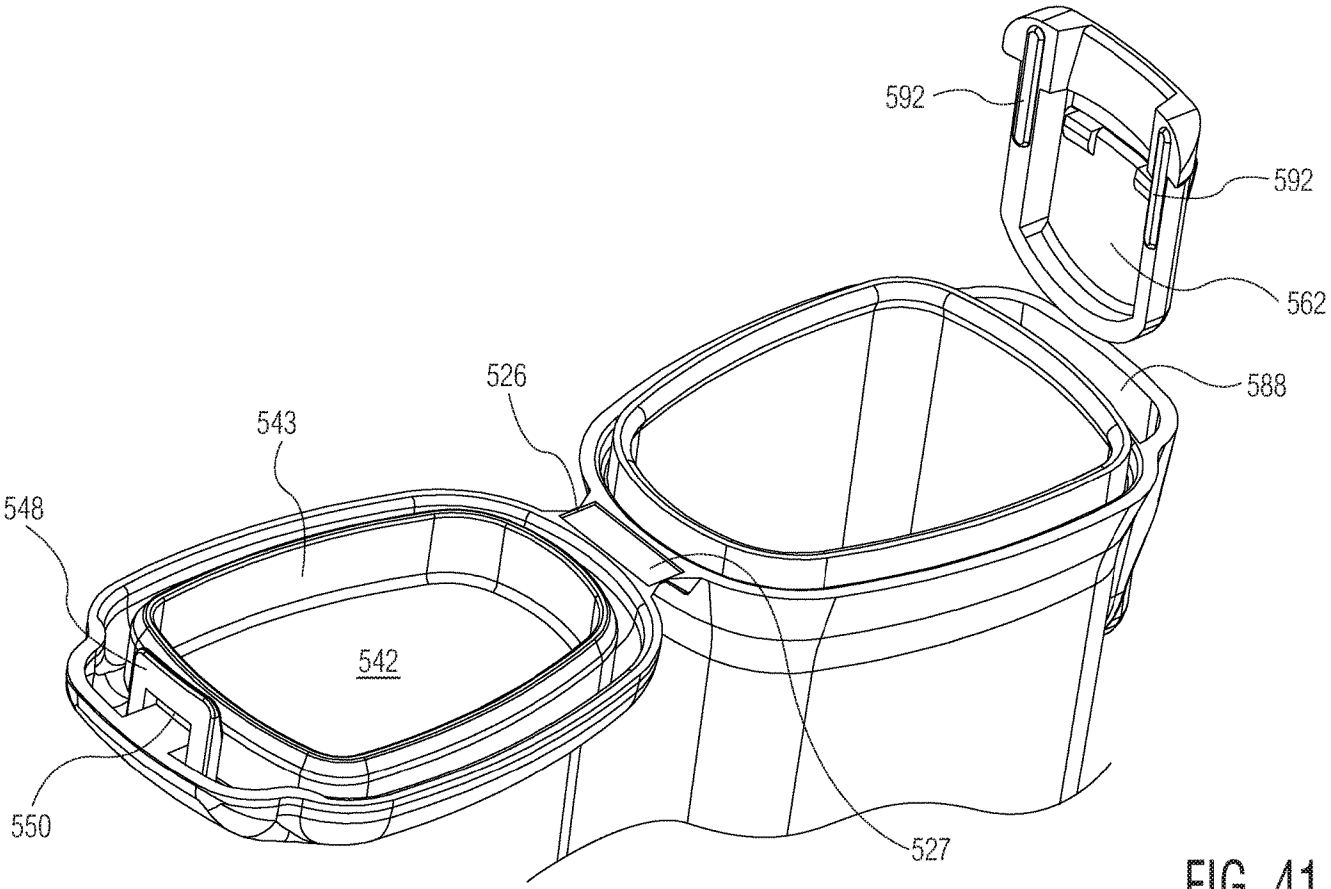
FIG. 41 is an enlarged exploded partial rear perspective view of the container of FIG. 38.
Figure 42:
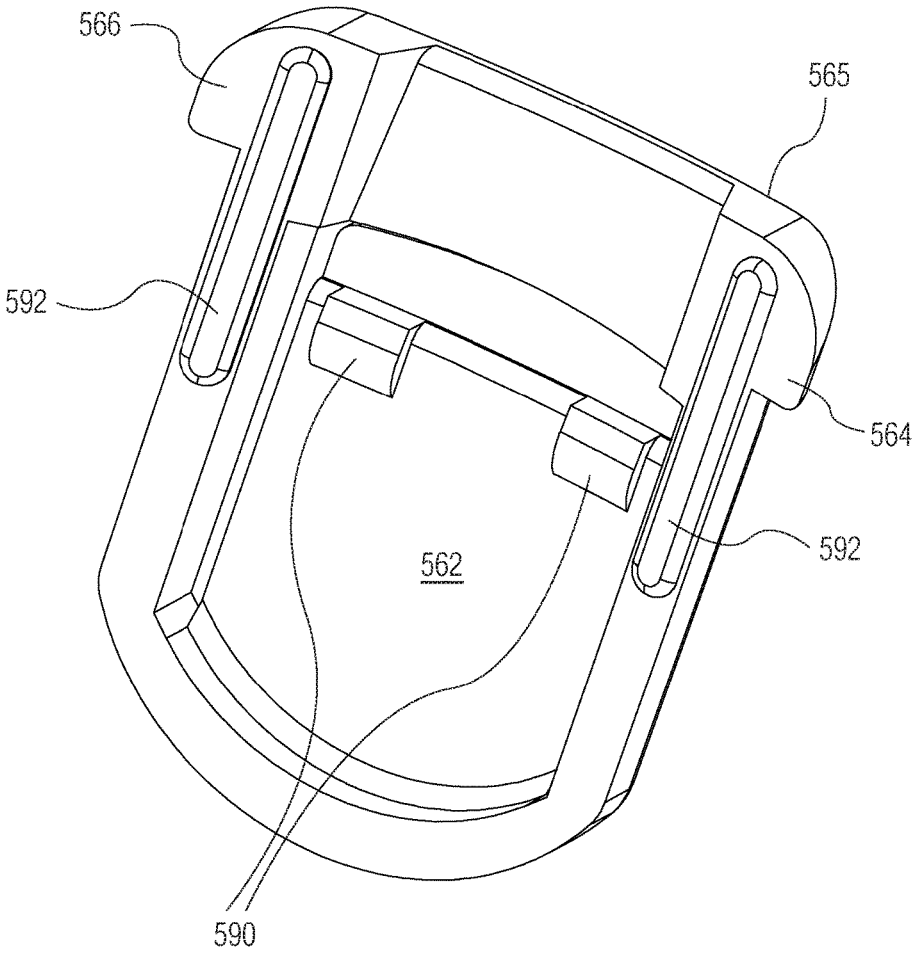
FIG. 42 is an enlarged rear perspective view of the release of the container of FIG. 38.

As best shown in FIG. 39, the container body 520 includes two ribs 588 protruding from the sidewall 530 under the bridge 582 of the release housing 580. As best shown in FIG. 42, the button 562 includes two ribs 590 protruding from the rear thereof. In use, the ribs 590 of the button 562 are stopped by the complementary ribs 588 of the container body 520 to prevent the button 562 from being completely removed from the release housing 580.

Figure 43:
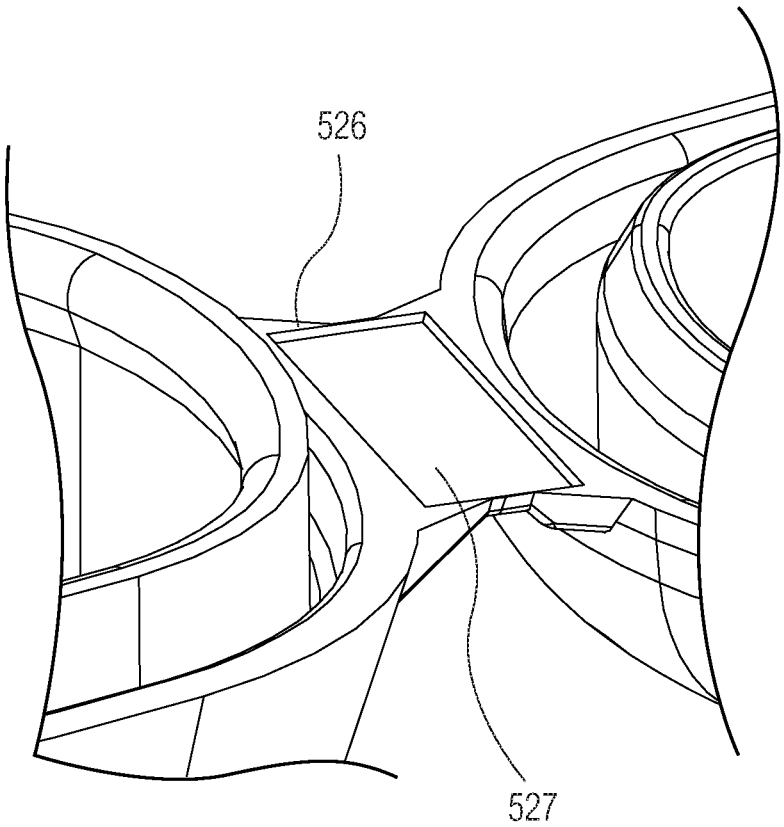
FIG. 43 is an enlarged perspective view of the hinge of the container of FIG. 38.

Optionally, as best shown in FIG. 43, the hinge 526 includes a shallow impression 527, e.g., optionally about 0.15 mm deep. The impression helps to allow the lid 540 to close flush with the container body 530, which may facilitate a better seal.

Figure 44:
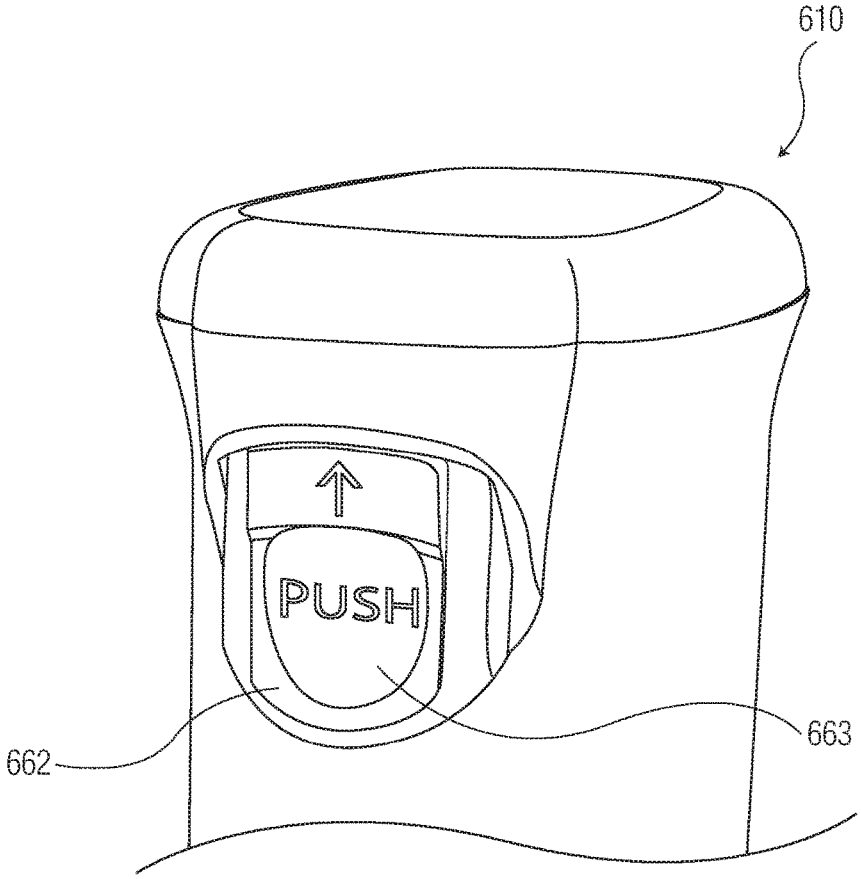
FIG. 44 is an enlarged partial front perspective view of a seventh embodiment of a container according to the invention, in a closed position and with a release in a locked position.
Figure 45:
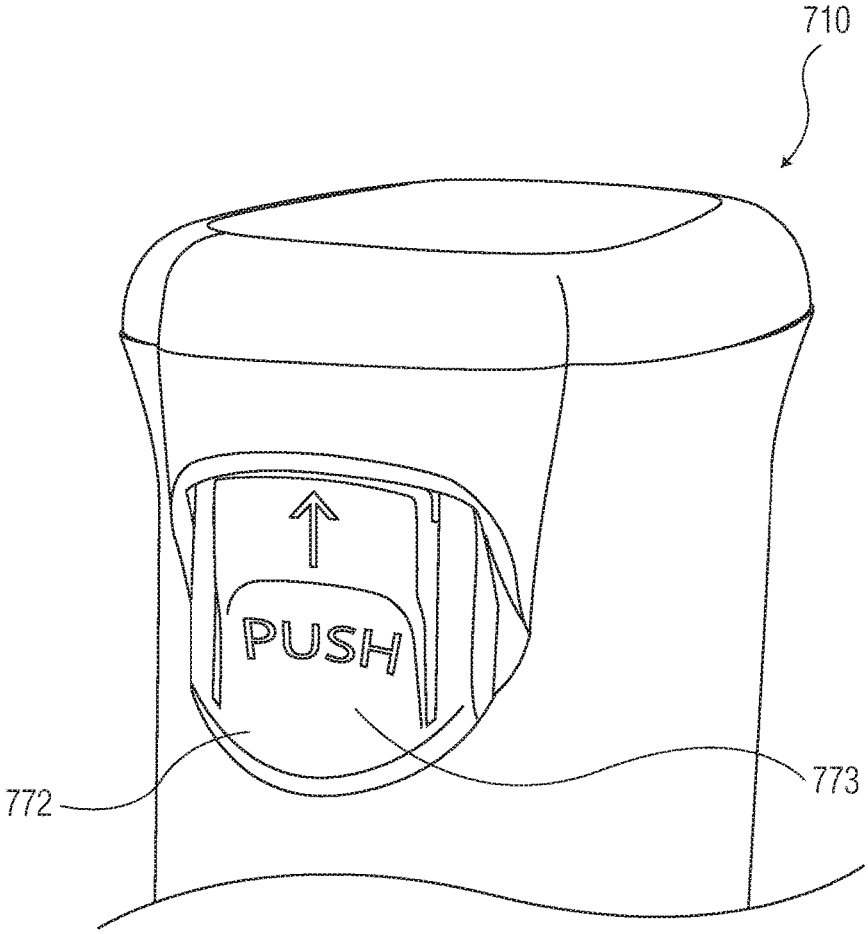
FIG. 45 is an enlarged partial front perspective view of an eighth embodiment of a container according to the invention, in a closed position and with a release in a locked position.

Referring to FIGS. 44 and 45, there are shown alternative container assemblies 610, 710 according to the invention. These assemblies 610, 710 each respectively include a release button 662, 772, which respectively have concave impressions 663, 773 of alternative geometries. The concave impressions 663, 773 may assist in maintaining a user's finger/thumb contact with the button 662, 772 when a user depresses and vertically moves the button 662, 762.

Each of the containers described above 10, 110, 210, 310, 410, 510, 610, 710 could be provided in various sizes, depending on the intended use of the container. In one preferred embodiment, the container 10, 110, 210, 310, 410, 510, 610, 710 has a length between 60 and 100 mm. More preferably, the container 10, 110, 210, 310, 410, 510, 610, 710 has a length of between 68 and 88 mm. Most preferably, the container 10, 110, 210, 310, 410, 510, 610, 710 has a length of about 79.5 mm. It has been found, for example, that a 79.5 mm length container provided desired gripping surface for an average adult user for one-handed opening, while still maintaining preferred form and fit for carry. It should be understood, however, that the present invention is not limited to the foregoing preferred lengths.

While the preferred embodiments of the invention have been described in detail above, the invention is not limited to the specific embodiments described, which should be considered as merely exemplary. Any embodiment of the container 10, 110, 210, 310, 410, 510, 610, 710 could be provided with any or all of the features described with respect to that embodiment, alone or in combination, or could be combined or substituted with the features described with respect to any other embodiment.

What is claimed is:

1. A container for storing products therein, the container comprising:

a container body defining an interior for housing products, and an opening leading to the interior;

a lid that is movable with respect to the container body to move the container between a closed position in which the lid covers the opening and encloses the products therein, and an opened position in which the opening is exposed;

a housing affixed to an upper portion of the container body, adjacent to the opening; and a release that is movably housed within the housing, the release being configured to move between a locked position in which the release retains the lid in the closed position, and an unlocked position in which the release permits the lid to move into the opened position;

wherein the release is movable from the locked position to the unlocked position by a first movement comprising depressing the release in a radially inward direction, wherein, in the unlocked position, the release is configured to be moved in a second movement comprising sliding the release in an axially upward direction such that the release contacts and pushes up on the lid, thereby disengaging the lid from the container body so as to actuate movement of the lid from the closed position to the opened position.

2. The container of claim 1, wherein the container is a vial comprising a bottom wall having an outer edge and a tubular side wall extending upward from the outer edge, the bottom wall and the side wall defining the interior, and an upper edge of the side wall defining the opening.

3. The container of claim 2, further comprising an engagement ridge at the upper edge of the side wall, the engagement ridge configured to engage a portion of the lid when the container is in the closed position.

4. The container of claim 2, further comprising a rim that extends radially outwardly from the side wall at a location between the housing and the opening.

5. The container of claim 1, wherein the lid has an outer perimeter that is less than an outer perimeter of the upper edge of the side wall.

6. The container of claim 1, wherein the lid is attached to the container body by a hinge, and the lid pivots about the hinge to move the container between the closed position and the opened position.

7. The container of claim 1, wherein the lid comprises a base wall configured to cover the opening when the container is in the closed position and a seal that extends downwardly from a bottom surface of the base wall, the seal configured to engage the container body when the container is in the closed position to form a substantially moisture tight seal between the lid and the container body.

8. The container of claim 2, wherein the lid comprises a base wall configured to cover the opening when the container is in the closed position, and a skirt that extends downward from the base wall about an outer perimeter thereof, wherein the skirt contacts an upper edge of the side wall when the container is in the closed position.

9. The container of claim 1, wherein:

the lid further comprises at least one of a tab or a front portion that is positioned to extend over the housing when the container is in the closed position;

the at least one of a tab or a front portion is formed as an extension of the base wall and has an end that is positioned flush with or radially inward with respect to an outer surface of the housing when the container is in the closed position; and a bottom surface of the at least one of a tab or a front portion faces an upper side of the housing when the container is in the closed position.

10. The container of claim 1, wherein the housing comprises a bridge wall, the bridge wall having first and second ends that that attach to the container body and define a housing space between the container body and the bridge wall, the housing space dimensioned for slidably housing the release.

11. The container of claim 1, wherein the release comprises a button configured to actuate the first movement and the second movement.

12. The container of claim 11, wherein the button projects from beneath the bridge wall when in the locked position.

13. The container of claim 12, wherein the button clears the bridge wall during the first movement, and passes beneath the bridge wall during the second movement.

14. The container of claim 1, wherein the release is biased to the locked position.

15. A method of moving a container between an opened position and a closed position, the method comprising:

providing the container, wherein the container comprises:

a container body defining an interior for housing the products, and an opening leading to the interior;

a lid that is movable with respect to the container body to move the container between a closed position in which the lid covers the opening, and an opened position in which the opening is exposed;

a housing affixed to an upper portion of the container body, adjacent to the opening; and a release that is movably housed within the housing, the release configured to move between a locked position in which the release retains the lid in the closed position, and an unlocked position in which the release permits the lid to move the into the opened position;

moving the release from the locked position to the unlocked position by moving the release within the housing in a radially inward direction;

wherein once the release is in the unlocked position, the method comprises sliding the release in an axially upward direction such that the release contacts and pushes up on the lid, thereby disengaging the lid from the container body so as to actuate movement of the lid from the closed position to the opened position.

16. The method of claim 15, wherein the lid is pivotably affixed to the container body by a hinge, and moving the lid from the closed position to the opened position comprises pivoting the lid about the hinge.

17. The method of claim 16, wherein the method further comprises closing the container by moving the lid from the opened position to the closed position, wherein the release is biased to the locked position, and wherein the release returns to the locked position after closing the lid.

* * * * *